US010259228B2

(12) United States Patent
Osakabe et al.

(10) Patent No.: US 10,259,228 B2
(45) Date of Patent: Apr. 16, 2019

(54) SUPPLY APPARATUS

(71) Applicant: BROTHER KOGYO KABUSHIKI KAISHA, Nagoya-shi, Aichi-ken (JP)

(72) Inventors: Yoshinori Osakabe, Seto (JP); Masako Kawagoe, Nagoya (JP); Taichi Shirono, Nagoya (JP); Kenichi Hirata, Nagoya (JP); Hiroshi Taira, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 9 days.

(21) Appl. No.: 15/630,325

(22) Filed: Jun. 22, 2017

(65) Prior Publication Data

US 2018/0001649 A1 Jan. 4, 2018

(30) Foreign Application Priority Data

Jun. 30, 2016 (JP) ..... 2016-130801
Oct. 21, 2016 (JP) ..... 2016-207322

(51) Int. Cl.
*B41J 29/13* (2006.01)
*B41J 2/175* (2006.01)

(52) U.S. Cl.
CPC ..... *B41J 2/1752* (2013.01); *B41J 2/175* (2013.01); *B41J 2/17509* (2013.01); *B41J 2/17513* (2013.01); *B41J 2/17523* (2013.01); *B41J 2/17533* (2013.01); *B41J 2/17553* (2013.01); *B41J 29/13* (2013.01)

(58) Field of Classification Search
CPC .. B41J 2/1752; B41J 2/17523; B41J 2/17533; B41J 2/17513; B41J 2/175
See application file for complete search history.

(56) References Cited

U.S. PATENT DOCUMENTS

2012/0056938 A1 3/2012 Ishizawa et al.
2015/0360474 A1* 12/2015 Igarashi ..... B41J 2/17513 347/86
2017/0266977 A1* 9/2017 Osakabe ..... B41J 2/17513

FOREIGN PATENT DOCUMENTS

JP 2012-51306 A 3/2012

* cited by examiner

*Primary Examiner* — Sharon A. Polk
(74) *Attorney, Agent, or Firm* — Merchant & Gould P.C.

(57) ABSTRACT

A supply apparatus includes: a tank in which a liquid supply section is formed, the liquid supply section having a liquid storage chamber, an inlet for supplying liquid to the liquid storage chamber, and a liquid flow path, the liquid storage chamber being demarcated by first surfaces facing in a first direction, a second surface joining the first surfaces, and a third surface separated from the second surface in a second direction orthogonal to the first direction; a holding member holding a part of the tank from one side in the second direction; a coupling member having a coupling section coupled to the liquid supply section of the tank from another side in the second direction to allow flow of the liquid; and a casing supporting at least one of the holding member and the coupling member.

18 Claims, 18 Drawing Sheets

SUPPLY APPARATUS

CROSS REFERENCE TO RELATED APPLICATION

The present application claims priorities from Japanese Patent Application No. 2016-130801, filed on Jun. 30, 2016 and Japanese Patent Application No. 2016-207322, filed on Oct. 21, 2016, the disclosures of which are incorporated herein by reference in its entirety.

BACKGROUND

Field of the Invention

The present invention relates to a supply apparatus which includes a tank that can be replenished with liquid via an inlet.

Description of the Related Art

There is known a printer that includes: a plurality of tanks that can be replenished with ink; and a recording head that records an image on a sheet by discharging, from nozzles, the ink supplied from the tank. When the ink in the tank is consumed, a user can replenish with ink stored in a bottle, from an inlet provided in the tank.

SUMMARY

When each of the tanks is installed in the printer, at least a tolerance portion of misalignment occurs for each of the tanks. Thereupon, when the plurality of tanks is installed in the printer, a maximum value of misalignment will be a value of tolerance of each of the tanks multiplied by the number of tanks.

This kind of misalignment can be reduced by installing in the printer a tank unit in which the plurality of tanks has been integrated. As a result, the misalignment can be suppressed to a value of tolerance of one tank unit. In the above described conventional printer, each of the tanks had structure in which a film was attached to only one of a pair of surfaces. Therefore, it was easy for the plurality of tanks to be integrated.

However, in the case that each of the tanks is configured such that a film is attached to both of the pair of surfaces, it has been difficult for the plurality of tanks to be integrated while maintaining ease of attachment of the film.

In addition, the above-described kind of misalignment can be reduced by installing the plurality of tanks in the printer in a state that the plurality of tanks has been aligned without gaps therebetween. As a result, the misalignment can be suppressed to a value of tolerance of one tank.

However, in the case that each of the tanks is configured such that a film is attached to both of the pair of surfaces, there is a risk that when the plurality of tanks is installed in the printer in a state that the plurality of tanks has been aligned without gaps therebetween, films of adjacent tanks make contact with each other whereby the films are damaged. Therefore, it is desirable that a gap is secured between adjacent tanks which is sufficient to prevent the films from contacting each other even if an impact of transportation or dropping is applied to the printer.

Moreover, the tank is positioned with respect to a casing of the printer, and is coupled to, for example, a coupling section having an ink flow path to the recording head. As a result, ink is supplied to the recording head from the tank. If the tank and the coupling section are not positioned accurately with respect to the casing, there is a risk that a gap occurs between the tank and the coupling section, and that ink leaks from the gap.

An object of the present teaching is to provide a supply apparatus that, even when a plurality of tanks each configured having a film attached to both of a pair of surfaces to which films are attached are aligned in the supply apparatus, misalignment of each of the tanks can be reduced.

Another object of the present teaching is to provide a supply apparatus in which the tank can be supported by a casing by being positioned accurately with respect to a coupling section.

According to a first aspect of the present teaching, there is provided a supply apparatus including: a tank in which a liquid supply section is formed, the liquid supply section having a liquid storage chamber, an inlet for supplying liquid to the liquid storage chamber, and a liquid flow path, the liquid storage chamber being demarcated by a pair of first surfaces facing in a first direction, a second surface joining the pair of first surfaces, and a third surface separated from the second surface in a second direction orthogonal to the first direction, the liquid flow path extending in the second direction from the liquid storage chamber; a holding member configured to hold a part of the tank from one side in the second direction; a coupling member having a coupling section, the coupling section being coupled to the liquid supply section of the tank from another side in the second direction to allow the liquid in the liquid storage chamber to flow; and a casing configured to support at least one of the holding member and the coupling member, wherein the second surface and the third surface compose a tank main body, at least a part of each of the pair of first surfaces is formed by a film attached to the tank main body, and the holding member has an abutting section that abuts against the tank main body from the one side in the second direction and a first engaging section that engages with the tank main body such that the tank is movable in the first direction.

In a state where the liquid supply section of the tank and the coupling section of the coupling member have been coupled, the abutting section of the holding member abuts on the tank main body from one side in the second direction. As a result, the tank moves to one side in the second direction, whereby the liquid supply section and the coupling section are prevented from becoming uncoupled. Moreover, in a state where the tank main body and the first engaging section of the holding member have been engaged, the tank is movable in the first direction, hence the tank is positioned with respect to the first direction with reference to a coupling position of the liquid supply section and the coupling section.

According to a second aspect of the present teaching, there is provided a supply apparatus including: tanks each having a liquid storage chamber demarcated by a pair of first surfaces facing in a first direction and an inlet for supplying a liquid to the liquid storage chamber; a holding member configured to hold the tanks in a state of being aligned in the first direction; and a casing configured to support the holding member, wherein at least a part of each of the pair of first surfaces is formed by a film, and the holding member has abutting sections that respectively abut against the tanks to position the tanks in the first direction while leaving a gap between each of the tanks.

Due to the above-described structure, the holding member holds the plurality of tanks, whereby the plurality of tanks is integrated. As a result, in a state where the holding member has been supported by the casing, misalignment between the tanks can be reduced.

DESCRIPTION OF THE EMBODIMENTS

Figure 1A:
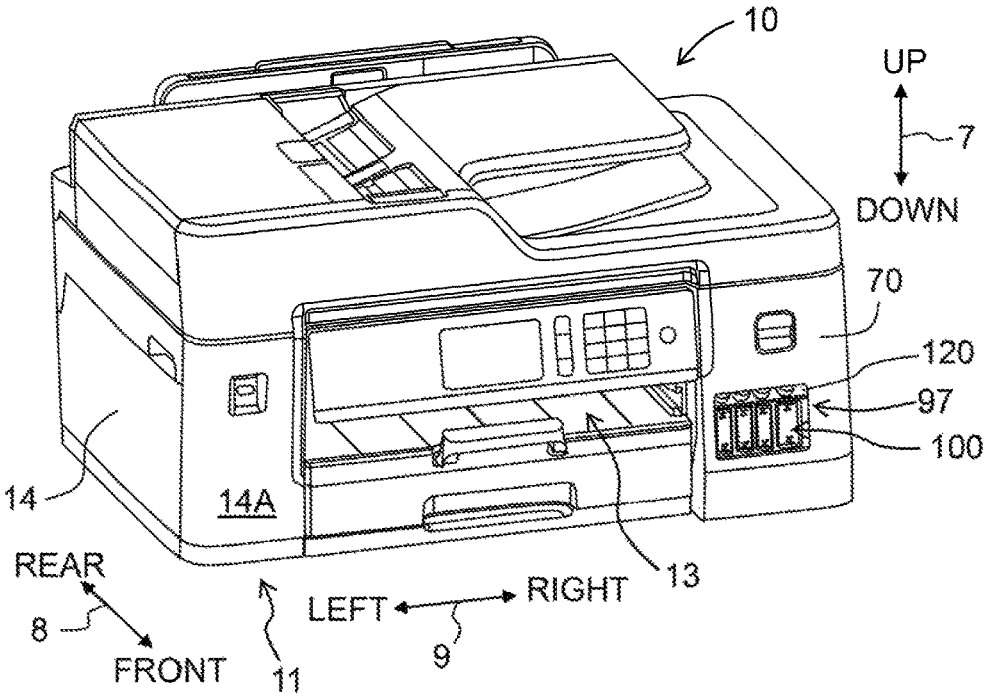
FIG. 1A is a perspective view of external appearance of a multifunction peripheral where a cover is in a closed position.

An embodiment of the present teaching will be described below. Note that the embodiment described below is merely an example of the present teaching, and it goes without saying that the embodiment of the present teaching may be appropriately changed in a range that does not alter the gist or essential characteristics of the present teaching. In the description below, a posture (the posture of FIGS. 1A and 1B) where a multifunction peripheral 10 and an ink tank 100 installed in the multifunction peripheral 10 are usably disposed in a horizontal plane will be described as a "usable posture". An up-down direction 7 is defined with reference to the usable posture. A front-rear direction 8 (an example of a second direction) is defined assuming a surface provided with an opening 13 of the multifunction peripheral 10 to be a front surface. A left-right direction 9 (an example of a first direction) is defined viewing the multifunction peripheral 10 from the front surface. In the present embodiment, in the usable posture, the up-down direction 7 corresponds to a vertical direction, and the front-rear direction 8 and the left-right direction 9 correspond to horizontal directions. Note that an upward orientation is a component of the up-down direction 7, and a downward orientation is also a component of the up-down direction 7. Similarly, a leftward orientation and a rightward orientation are each components of the left-right direction 9. A frontward orientation and a rearward orientation are each components of the front-rear direction 8.

<Overall Structure of Multifunction Peripheral 10>

Figure 1B:
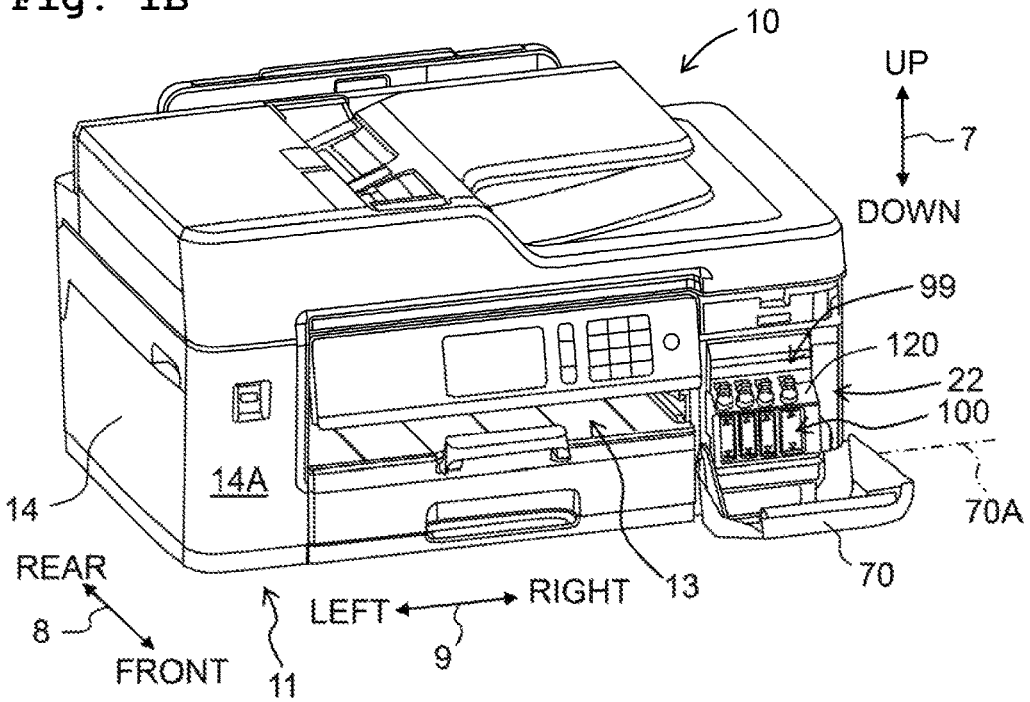
FIG. 1B is a perspective view of external appearance of the multifunction peripheral where the cover is in an open position.
Figure 1C:
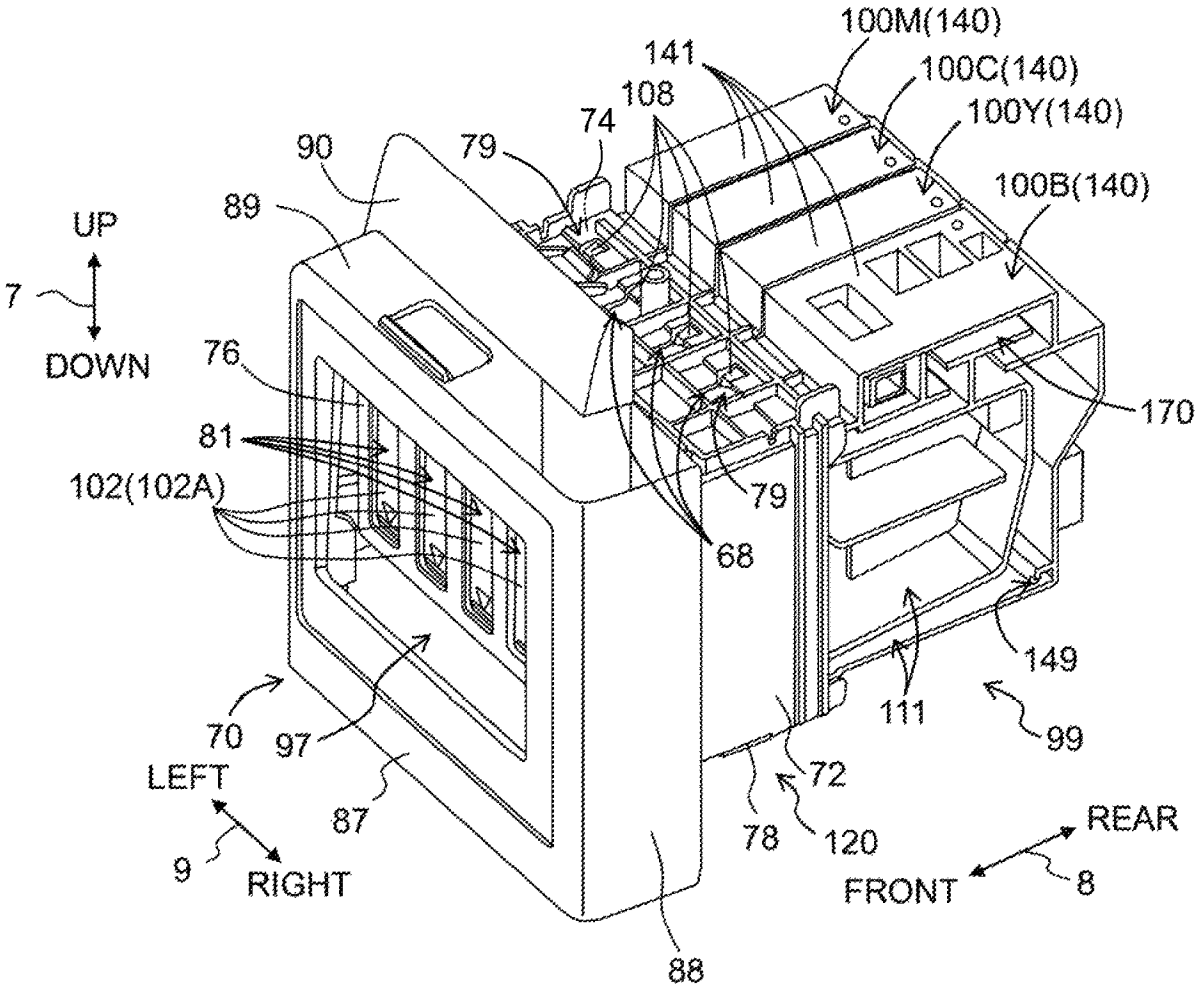
FIG. 1C is a perspective view of a tank set and the cover in the closed position.

As depicted in FIGS. 1A and 1B, the multifunction peripheral 10 (an example of a supply apparatus) has roughly a rectangular parallelepiped shape. A printer unit 11 that records an image on a sheet 12 (refer to FIG. 2) by an ink-jet recording system, is provided in a lower section of the multifunction peripheral 10. The printer unit 11 has a casing 14. The opening 13 is formed in a front wall 14A of the casing 14. As depicted in FIG. 2, the following are disposed on the inside of the casing 14, namely, a feed unit 15, a feed tray 20, a discharge tray 21, a conveyance roller unit 54, a recording unit 24, a discharge roller unit 55, a platen 42, a tank set 99, a holding member 120 (refer to FIG. 1), and a coupling member 200 (refer to FIG. 6). The multifunction peripheral 10 has various functions such as a facsimile function and a print function.

<Feed Tray 20, Discharge Tray 21>

The opening 13 is formed in the front surface and in a central section in the left-right direction 9 of the multifunction peripheral 10. As depicted in FIGS. 1A and 1B, the feed tray 20 is inserted/removed in the front-rear direction 8 into/from the multifunction peripheral 10, via the opening 13, by a user. As depicted in FIG. 2, the feed tray 20 can support a stacked plurality of the sheets 12. The discharge tray 21 is disposed upwardly of the feed tray 20 and is capable of being extended/contracted independently of the feed tray 20, regardless of insertion/removal of the feed tray 20. The discharge tray 21 supports the sheet 12 that has been discharged from between the recording unit 24 and the platen 42 by the discharge roller unit 55.

<Feed Unit 15>

The feed unit 15 feeds to a conveyance passage 65 the sheet 12 supported by the feed tray 20. As depicted in FIG. 2, the feed unit 15 includes a feed roller 25, a feed arm 26, and a shaft 27. The feed roller 25 is rotatably supported by a distal end of the feed arm 26. Reverse rotation of a conveyance motor (not illustrated) results in the feed roller 25 rotating such that the sheet 12 is conveyed in a conveyance orientation 16. Hereafter, the feed roller 25, a conveyance roller 60, and a discharge roller 62 rotating in an orientation by which the sheet 12 is conveyed in the conveyance orientation 16 will be described as "forward rotation". The feed arm 26 is pivotably supported by the shaft 27 which is supported by a frame of the printer unit 11. The feed arm 26 is biased so as to pivot to a feed tray 20 side by an elastic force due to the likes of its own weight or a spring.

<Conveyance Passage 65>

Figure 2:
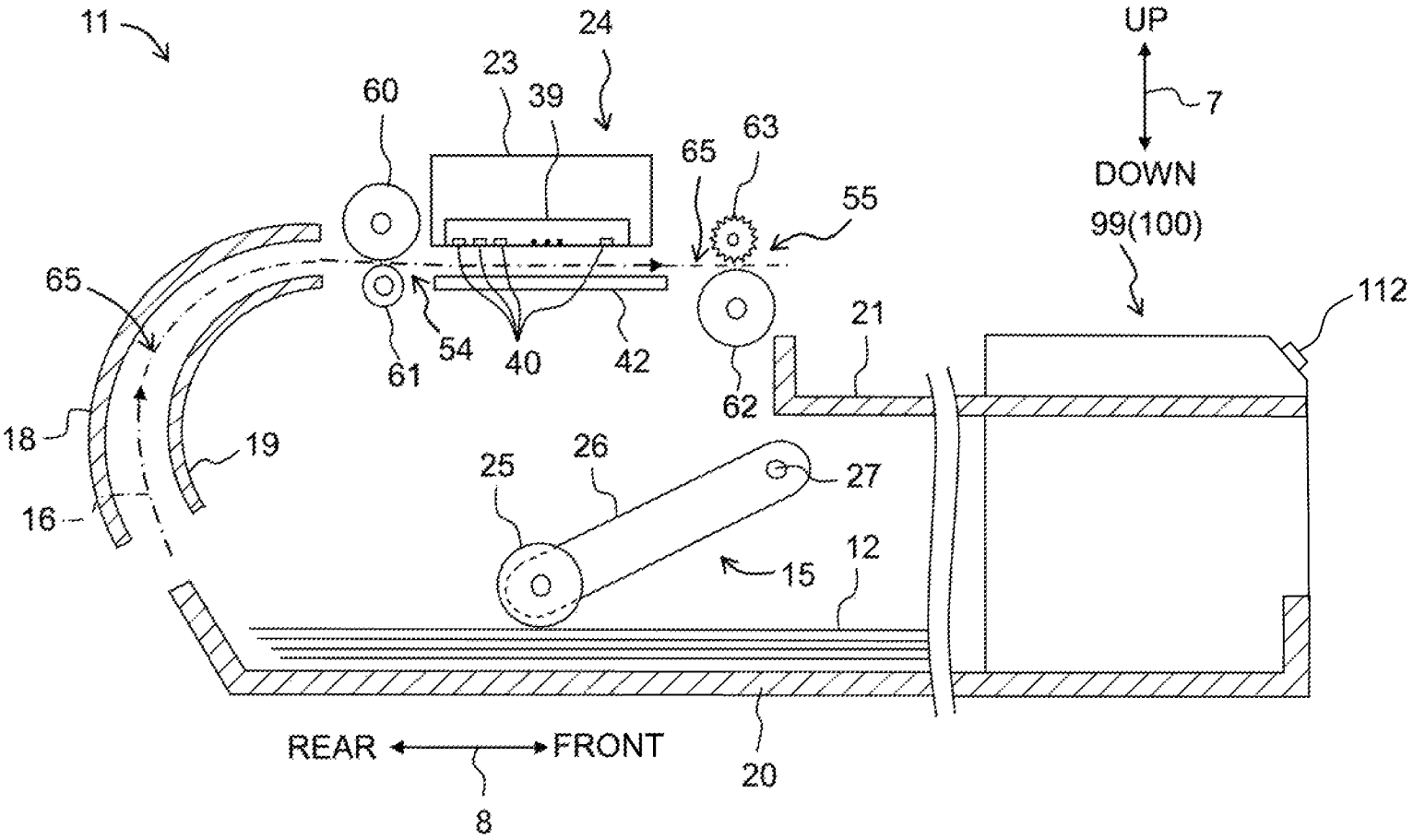
FIG. 2 is a longitudinal cross-sectional view depicting schematically an internal structure of a printer unit.
Figure 3:
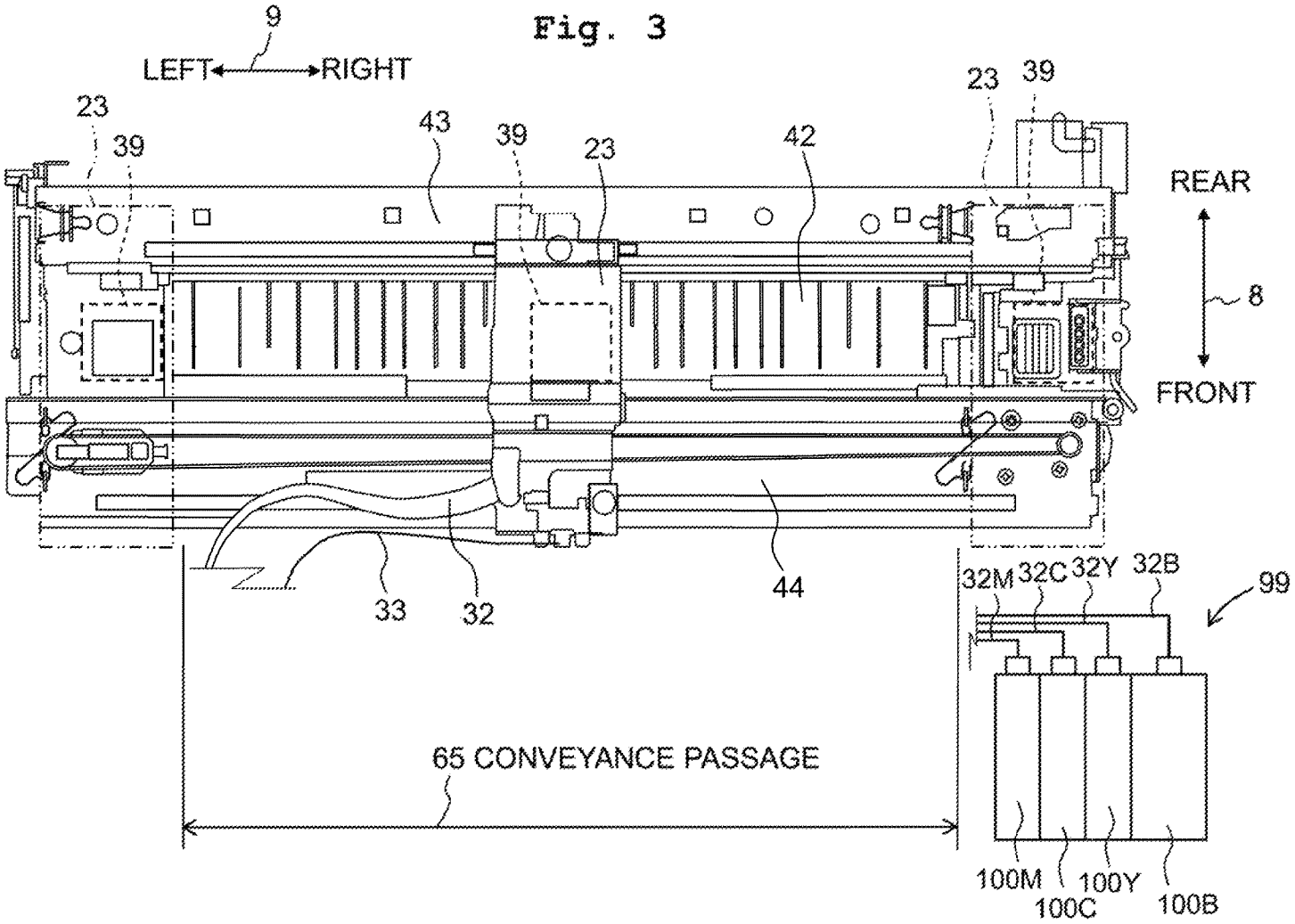
FIG. 3 is a plan view depicting an arrangement of a carriage and the tank set.

As depicted in FIG. 2, the conveyance passage 65 is a passage that extends to a rear of the printer unit 11 from a rear end section of the feed tray 20, makes a U-turn frontward while extending upwardly at the rear of the printer unit 11, and passes along a space between the recording unit 24 and the platen 42 to reach the discharge tray 21. Part of the conveyance passage 65 is a space formed by an outer guide member 18 and an inner guide member 19 that face each other with a certain spacing between them on the inside of the printer unit 11. As depicted in FIGS. 2 and 3, a portion between the conveyance roller unit 54 and the discharge roller unit 55, of the conveyance passage 65 is provided in roughly the central section in the left-right direction 9 of the multifunction peripheral 10, and extends in the front-rear direction 8. The conveyance orientation 16 of the sheet 12 in the conveyance passage 65 is indicated by a dot-chain line arrow in FIG. 2.

<Conveyance Roller Unit 54>

As depicted in FIG. 2, the conveyance roller unit 54 is disposed upstream in the conveyance orientation 16 of the recording unit 24. The conveyance roller unit 54 includes the conveyance roller 60 and a pinch roller 61 that face each other. The conveyance roller 60 is driven by the conveyance motor. The pinch roller 61 rotates in company with rotation of the conveyance roller 60. The sheet 12 is nipped by the conveyance roller 60 that forwardly rotates by forward rotation of the conveyance motor, and the pinch roller 61, whereby the sheet 12 is conveyed in the conveyance orientation 16.

<Discharge Roller Unit 55>

As depicted in FIG. 2, the discharge roller unit 55 is disposed downstream in the conveyance orientation 16 of the recording unit 24. The discharge roller unit 55 includes the discharge roller 62 and a spur wheel 63 that face each other. The discharge roller 62 is driven by the conveyance motor. The spur wheel 63 rotates in company with rotation of the discharge roller 62. The sheet 12 is nipped by the discharge roller 62 that forwardly rotates by forward rotation of the conveyance motor, and the spur wheel 63, whereby the sheet 12 is conveyed in the conveyance orientation 16.

<Recording Unit 24>

As depicted in FIG. 2, the recording unit 24 is disposed between the conveyance roller unit 54 and the discharge roller unit 55 in the conveyance orientation 16. The recording unit 24 is disposed so as to face the platen 42 in the up-down direction 7, sandwiching the conveyance passage 65 between itself and the platen 42. The recording unit 24 includes a carriage 23 and a recording head 39.

As depicted in FIG. 3, the carriage 23 is supported by guide rails 43, 44 that are disposed separated in the front-rear direction 8 and each provided extending in the left-right direction 9. The guide rails 43, 44 are supported by the frame of the printer unit 11. The carriage 23 is coupled to a publicly known belt mechanism provided in the guide rail 44. The belt mechanism is driven by a carriage motor (not illustrated). The carriage 23 coupled to the belt mechanism makes a reciprocating movement along the left-right direction 9 by drive of the carriage motor. A range of movement of the carriage 23 reaches to outer sides in the left-right direction 9 of the conveyance passage 65, as depicted by the dot-chain lines of FIG. 3.

An ink tube 32 and a flexible flat cable 33 are extended out from the carriage 23.

The ink tube 32 connects the tank set 99 and the recording head 39. The ink tube 32 supplies the recording head 39 with ink (an example of a liquid) stored in four ink tanks 100B, 100Y, 100C, 100M (these are sometimes indicated collectively as "ink tank 100") that configure the tank set 99. The ink tank 100 is an example of a tank. In detail, four ink tubes 32B, 32Y, 32C, 32M in which black, yellow, cyan, magenta inks flow are respectively extended out from the ink tanks 100B, 100Y, 100C, 100M, and connected to the carriage 23 in a state where these ink tubes 32B, 32Y, 32C, 32M have been bundled. The four ink tubes 32B, 32Y, 32C, 32M are sometimes described collectively as "ink tube 32".

The flexible flat cable 33 electrically connects a control board on which a control unit (not illustrated) is mounted and the recording head 39. The flexible flat cable 33 transmits to the recording head 39 a control signal outputted from the control unit.

As depicted in FIG. 2, the recording head 39 is mounted in the carriage 23. A plurality of nozzles 40 are disposed in a lower surface of the recording head 39. Tips of the plurality of nozzles 40 are exposed from the lower surface of the recording head 39. The recording head 39 discharges ink from the nozzle 40 as a minute ink droplet. In a process of the carriage 23 moving, the recording head 39 discharges the ink droplet toward the sheet 12 supported by the platen 42. As a result, an image is recorded on the sheet 12. Moreover, as a result, ink stored in the ink tanks 100B, 100Y, 100C, 100M is consumed.

<Platen 42>

As depicted in FIGS. 2 and 3, the platen 42 is disposed between the conveyance roller unit 54 and the discharge roller unit 55, in relation to the conveyance orientation 16. The platen 42 is disposed so as to face the recording unit 24 in the up-down direction 7, sandwiching the conveyance passage 65 between itself and the recording unit 24. The platen 42 supports, from below, the sheet 12 conveyed by the conveyance roller unit 54.

<Cover 70>

As depicted in FIG. 1B, an opening 22 is formed in a right section of the front wall 14A of the casing 14. A cover 70 is installed in the casing 14 so as to cover the opening 22. The cover 70 is pivotable between a closed position where the opening 22 is covered (position depicted in FIG. 1A) and an open position where the opening 22 is exposed (position depicted in FIG. 1B).

A pair of protrusions (not illustrated) are formed in a lower end vicinity of the opening 22 in the casing 14. The pair of protrusions face each other in the left-right direction 9. The protrusion on the right of the pair of protrusions protrudes leftwards toward the protrusion on the left. The protrusion on the left of the pair of protrusions protrudes rightwards toward the protrusion on the right.

Figure 1D:
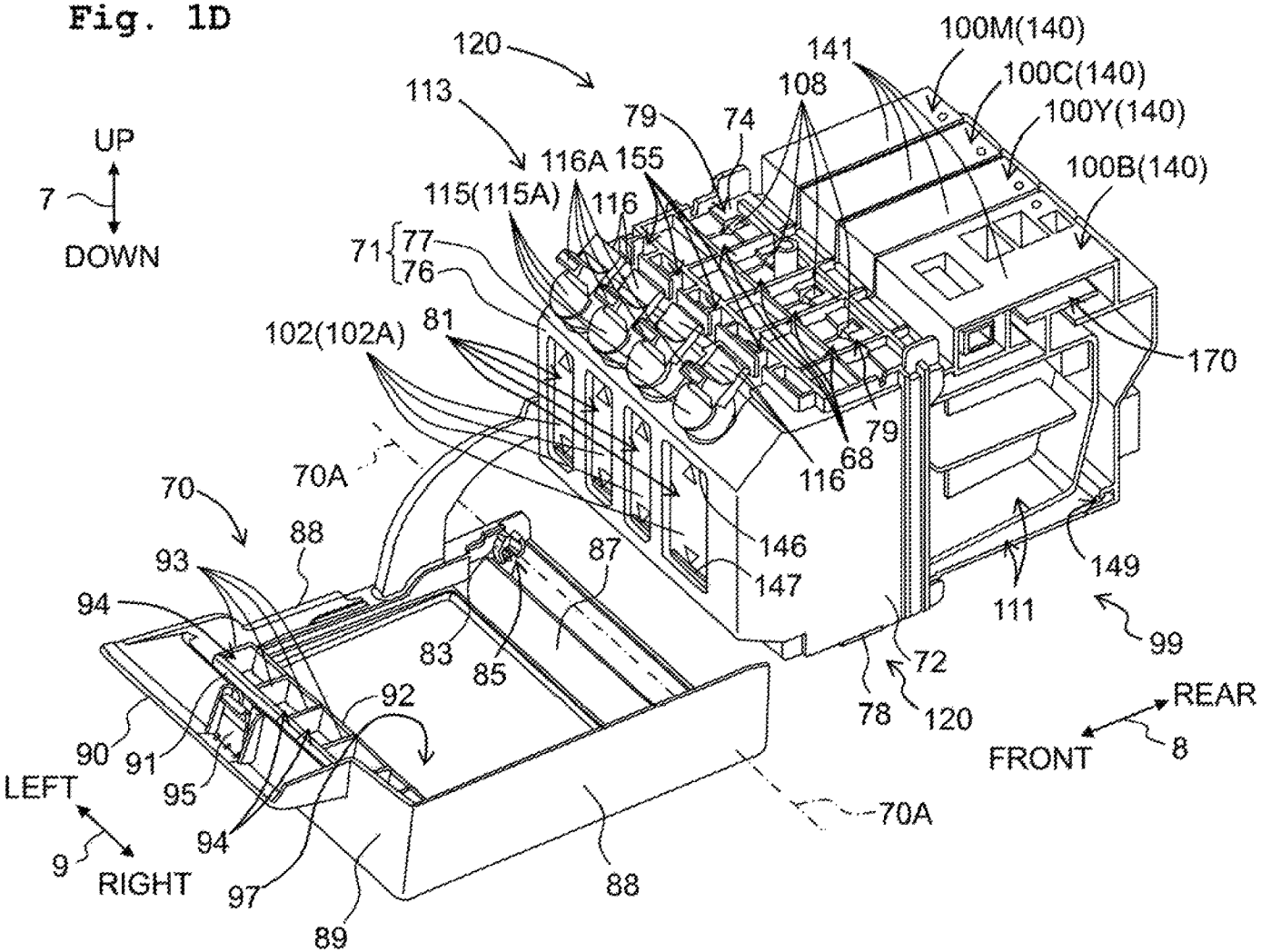
FIG. 1D is a perspective view of the tank set and the cover in the open position.

As depicted in FIG. 1D, a pair of protrusions are formed in the cover 70. A hole is formed in each of the pair of protrusions. Note that FIG. 1D depicts only a protrusion 83 and a hole 85 on the left, of the pair of protrusions and holes. The protrusion and hole on the right, of the pair of protrusions and holes are positioned in a portion hidden by a side wall 88. The pair of protrusions of the casing 14 are inserted into the holes formed in the cover 70, whereby the cover 70 is supported by the casing 14, pivotably around a pivotal axis 70A extending in the left-right direction 9 in a lower end vicinity of the casing 14.

As depicted in FIGS. 1C and 1D, the cover 70 includes a main wall 87, a pair of the side walls 88, an upper wall 89, and a protruding wall 90. Note that in the description of structure of the cover 70 below, each of the directions is depicted with reference to the closed position of the cover 70.

The main wall 87 is a wall extending in the up-down direction 7 and the left-right direction 9. As depicted in FIG. 1D, a first wall 91, a second wall 92 (an example of a restricting portion), ribs 93, and an opening 97 are formed in a rear surface of the main wall 87.

The first wall 91, the second wall 92, and the ribs 93 protrude rearward from the main wall 87. The first wall 91 and the second wall 92 extend in the left-right direction 9.

The first wall 91 is positioned in an upper end section of the main wall 87. The second wall 92 is positioned more downwardly than the first wall 91. The first wall 91 and the second wall 92 face each other in the up-down direction 7. The ribs 93 extend in the up-down direction 7. Five of the ribs 93 are disposed with a spacing between them in the left-right direction 9. The ribs 93 join the first wall 91 and the second wall 92. As a result, four spaces 94 are formed. Each of the spaces 94 is demarcated by the main wall 87, the first wall 91, the second wall 92, and the ribs 93. A rear end of each of the spaces 94 is open.

The opening 97 is formed more downwardly than the second wall 92. When the cover 70 is in the closed position, parts of each of the ink tank 100 and the holding member 120 can be visually confirmed from outside, via the opening 97.

As depicted in FIGS. 1C and 1D, the pair of side walls 88 protrude rearward from a right end and a left end of the main wall 87. The pair of side walls 88 face each other in the left-right direction 9. The pair of side walls 88 include in their lower end sections the above-mentioned pair of protrusions including the protrusion 83 on the left.

The upper wall 89 protrudes rearward from an upper end of the main wall 87.

The protruding wall 90 protrudes upwardly from the upper wall 89. A protrusion 95 protruding rearward is formed in the protruding wall 90. In a state where the cover 70 is in the closed position, the protrusion 95 is inserted into a recess (not illustrated) formed in the casing 14. As a result, the cover 70 is held in the closed position.

A space extends rearward of the opening 22 inside of the casing 14. The later-mentioned tank set 99 is disposed in this space. A front end of the space is demarcated by the cover 70 in the closed position. A rear end of the space is demarcated by an inner wall (not illustrated) disposed facing the cover 70 rearward of the cover 70.

Note that in the present embodiment, the cover 70 moves to the closed position and the open position by pivoting. However, a movement mode between the closed position and the open position is not limited to pivoting. For example, the cover 70 may be configured to be attachable/detachable to/from the casing 14. In this case, the cover 70 in a state of being attached to the casing 14 is the cover 70 in the closed position, and the cover 70 in a state of being detached from the casing 14 is the cover 70 in the open position.

<Tank Set 99>

Figure 6:
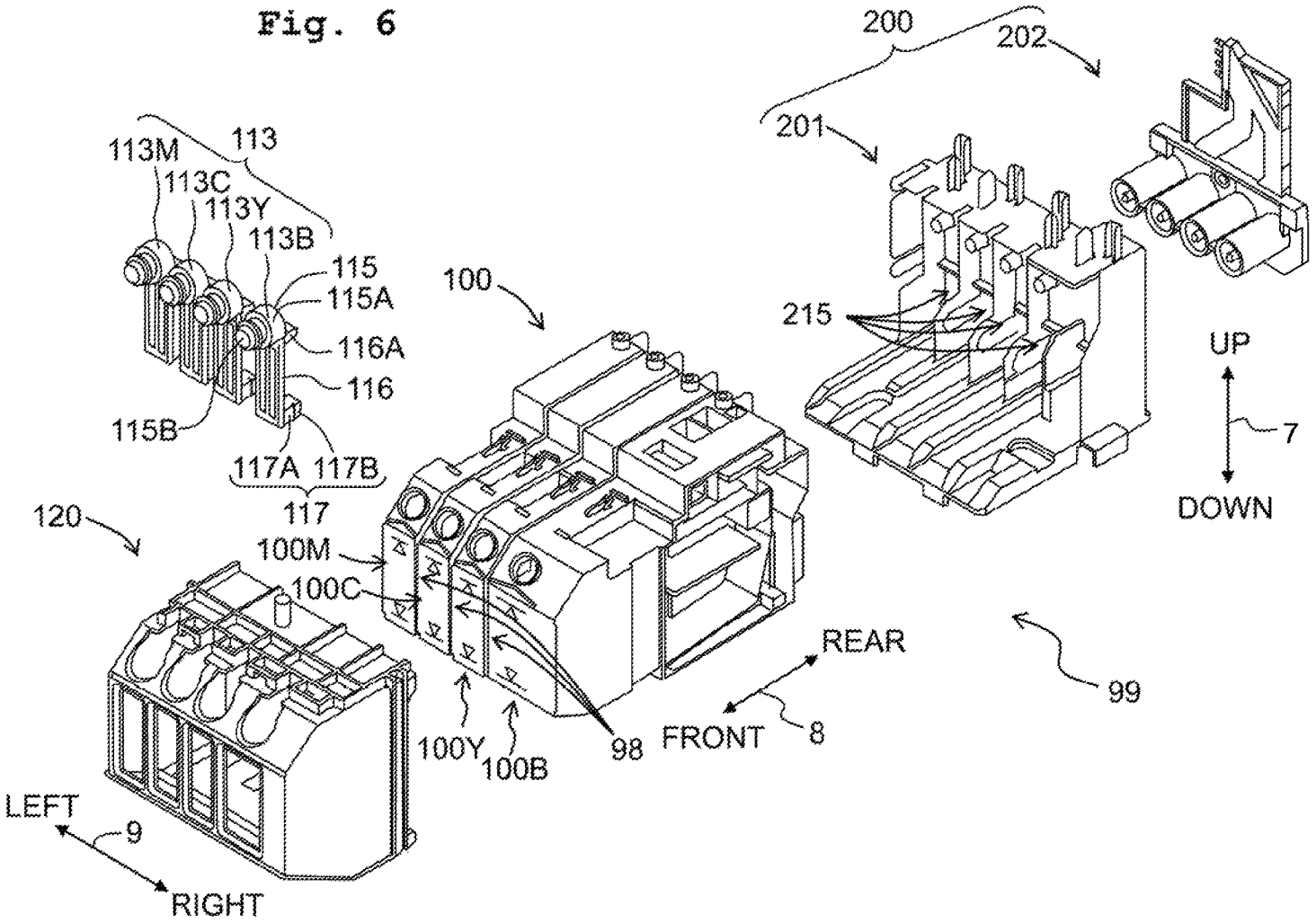
FIG. 6 is an exploded perspective view of the tank set.

The tank set 99 stores the ink supplied to the recording head 39. As depicted in FIG. 6, the tank set 99 includes the four ink tanks 100B, 100Y, 100C, 100M, the holding member 120, and the coupling member 200.

Different colors of inks are stored in the ink tanks 100B, 100Y, 100C, 100M, respectively. Specifically, black ink is stored in the ink tank 100B, yellow ink is stored in the ink tank 100Y, cyan ink is stored in the ink tank 100C, and magenta ink is stored in the ink tank 100M. However, the number of ink tanks 100 and colors of the inks are not limited to the above-described example. Structure of each of the ink tanks 100 will be mentioned later.

The holding member 120 and the coupling member 200 hold the four ink tanks 100B, 100Y, 100C, 100M in a state of being aligned along the left-right direction 9. Structure of the holding member 120 and the coupling member 200 will be mentioned later.

The four ink tanks 100B, 100Y, 100C, 100M are disposed in line along the left-right direction 9. Of the four ink tanks 100B, 100Y, 100C, 100M, the ink tank 100B is disposed most rightwards, and the ink tank 100M is disposed most leftwards. Note that arrangement positions of the ink tanks 100 are not limited to the above-described example. The ink tank 100B for black ink has a size, particularly a width in the left-right direction 9 which is larger than those of the ink tanks 100Y, 100C, 100M for color inks. Note that a magnitude relationship of sizes of the ink tanks 100 is not limited to the above-described example. The ink tank 100B has a permissible storage amount of ink which is larger than those of the other ink tanks 100Y, 100C, 100M. Note that a magnitude relationship of permissible storage amounts of the ink tanks 100 is not limited to the above-described example.

As depicted in FIGS. 1A and 1B, the tank set 99 is installed in a right front section on the inside of the casing 14. In other words, the tank set 99 is fixed to the multifunction peripheral 10 such that it cannot be easily removed from the multifunction peripheral 10. Note that "cannot be easily removed" means, for example, that the user cannot easily remove the tank set 99 from the casing 14 of the multifunction peripheral 10 in a state of ordinary use, and excludes cases such as when a skilled repairer removes the tank set 99 from the casing 14 of the multifunction peripheral 10 for repair. Therefore, the user should not be able to easily remove the tank set 99 from the casing 14 of the multifunction peripheral 10 in a state of ordinary use.

<Ink Tank 100>

Structure of the ink tanks 100 will be described in detail below. Since structure of the ink tanks 100Y, 100C, 100M for color inks are the same, hereafter, one of the ink tanks 100Y, 100C, 100M will be referred to as the ink tank 100 and its structure will be described. Moreover, structure of the ink tank 100B for black ink is similar to the structure of the ink tanks 100Y, 100C, 100M, hence after the structure of the ink tanks 100Y, 100C, 100M has been described, the structure of the ink tank 100B for black ink will be described for portions different from in the ink tanks 100Y, 100C, 100M. In this case, structure having a similar function even though shapes somewhat differ in the structure of the ink tank 100B and the ink tanks 100Y, 100C, 100M, will be assigned with identical reference symbols. Note that in the description below, unless specifically stated otherwise, the multifunction peripheral 10 and the ink tank 100 installed in the multifunction peripheral 10 are in the usable posture.

Figure 4A:
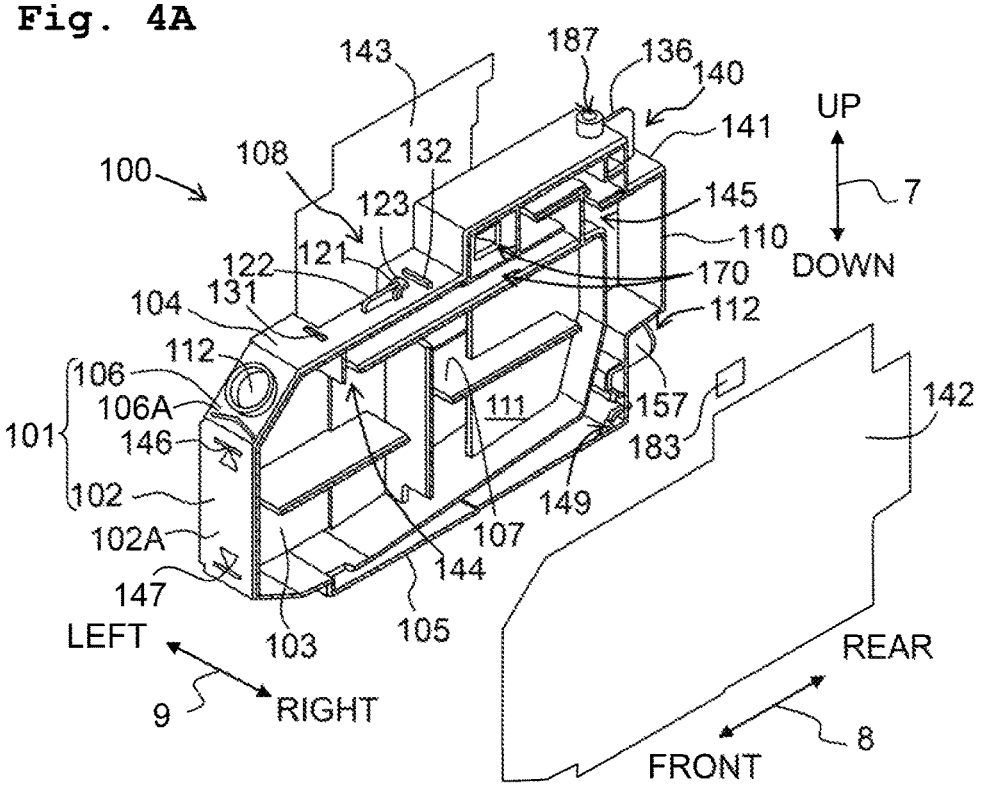
FIG. 4A is a front perspective view of an ink tank for a color ink.
Figure 4B:
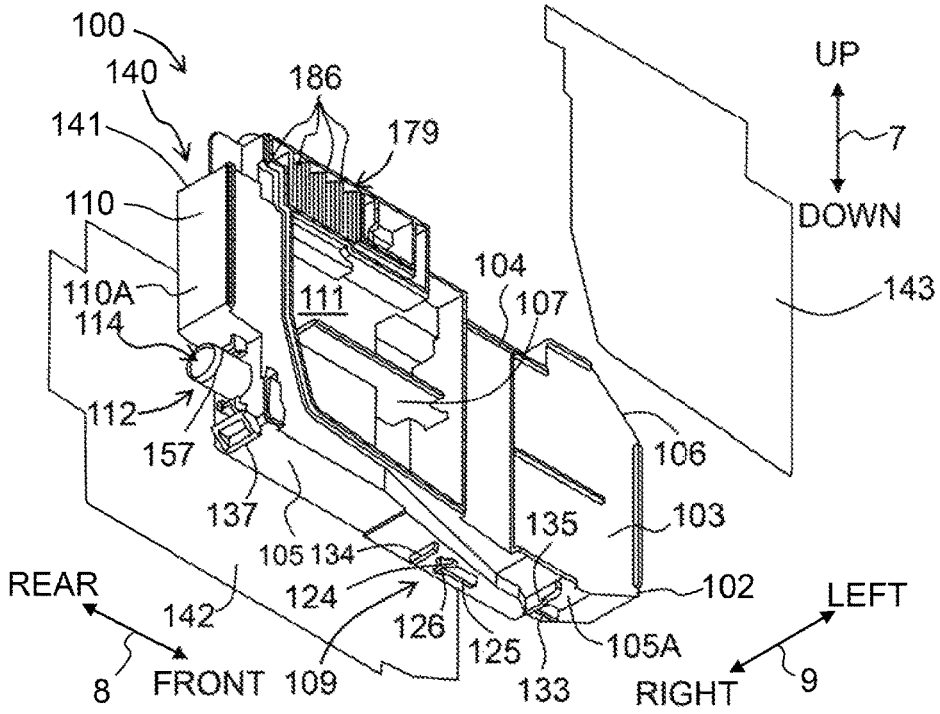
FIG. 4B is a rear perspective view of the ink tank for the color ink.

As depicted in FIGS. 4A and 4B, the ink tank 100 is formed by a casing 140 forming an outer shape of the ink tank. The casing 140 includes a tank main body 141 and two films 142, 143.

The tank main body 141 has a flat rectangular parallelepiped shape in which a dimension in the left-right direction 9 is short and dimensions in the up-down direction 7 and the front-rear direction 8 are longer than the dimension in the left-right direction 9. Moreover, the dimension in the front-rear direction 8 is longer than the dimension in the up-down direction 7.

The tank main body 141 is formed by a resin having sufficient translucency to enable ink in an ink chamber 111 to be visually confirmed from the outside of the ink tank 100. The tank main body 141 is formed by, for example, polypropylene. The tank main body 141 is integrally molded by, for example, injection molding a resin material. Rigidity of the tank main body 141 is higher than rigidity of the films 142, 143.

Note that the tank main body 141 may be configured by a material other than a resin. Moreover, the tank main body 141 may have structure in which a plurality of members is combined.

The tank main body 141 includes a front wall 101, a left wall 103, an upper wall 104, a lower wall 105, a rear wall 110, and an inner wall 107.

The front wall 101 is configured by an upright wall 102 and an inclined wall 106. The upright wall 102 extends in the up-down direction 7 and the left-right direction 9. The inclined wall 106 joins an upper end of the upright wall 102 and a front end of the upper wall 104. The inclined wall 106 inclines in the up-down direction 7 and the front-rear direction 8.

A front surface 102A of the upright wall 102 and a front surface 106A of the inclined wall 106 in each of the ink tanks 100, in other words a front surface (an example of a second surface) of the tank main body 141 of each of the ink tanks 100, is exposed to the outside of the multifunction peripheral 10, via the opening 97 of the cover 70 and the opening 22 of the casing 14. In other words, the front surface of the tank main body 141 of each of the ink tanks 100 is directed to an outer side of the casing 14. That is, each of the ink tanks 100 is disposed in the casing 14 such that the front surface of the tank main body 141 is accessible from outside of the casing 14 via the opening 22 and the opening 97. Due to there being such structure, the front surface of the tank main body 141 of each of the ink tanks 100 is visually confirmable from a front of the multifunction peripheral 10, and the user can visually confirm a residual amount of ink stored in each of the ink tanks 100.

The left wall 103 extends rearward from a left end of the front wall 101. An upper end of the left wall 103 is connected to a front section of the upper wall 104. A lower end of the left wall 103 is connected to a front section of the lower wall 105. In other words, the left wall 103 joins the left end of the front wall 101, a left end of the front section of the upper wall 104, and a left end of the front section of the lower wall 105. In other words, the left wall 103 is provided only in a front section of the tank main body 141 and is not provided in a rear section of the tank main body 141.

The upper wall 104 extends rearward from an upper end of the front wall 101 (rear end of the inclined wall 106). The front section of the upper wall 104 is connected to the upper end of the left wall 103.

The lower wall 105 extends rearward from a lower end of the front wall 101. The lower wall 105 is formed separated downwardly from the upper wall 104. As mentioned above, the front section of the lower wall 105 is connected to the lower end of the left wall 103.

A plurality of the inner walls 107 are disposed in a space surrounded by the front wall 101, the left wall 103, the upper wall 104, the lower wall 105, and the rear wall 110.

As depicted in FIG. 4A, a right surface of the tank main body 141 is open. The film 142 is welded to right surfaces of the front wall 101, the lower wall 105, the rear wall 110, the upper wall 104, and the inner wall 107, whereby the right surface of the tank main body 141 is sealed.

As depicted in FIG. 4B, a rear section of the left surface of the tank main body 141 is open. The film 143 is welded to left surfaces of the lower wall 105, the rear wall 110, the upper wall 104, and the inner wall 107, whereby the left surface of the tank main body 141 is sealed.

The front surface of the tank main body 141 (the front surface 102A of the upright wall 102 and the front surface 106A of the inclined wall 106) is fastened by a front end of the right surface of the tank main body 141 and a front end of the left surface of the tank main body 141. A rear surface of the tank main body 141 (a rear surface 110A of the rear wall 110) is fastened by a rear end of the right surface of the tank main body 141 and a rear end of the left surface of the tank main body 141. The rear surface 110A of the tank main body 141 is separated in the front-rear direction 8 from the front surface 102A. The rear surface 110A is an example of a third surface. The right surface of the tank main body 141 and the left surface of the tank main body 141 face each other in the left-right direction 9. The right surface and the left surface of the tank main body 141 are an example of a pair of first surfaces.

As depicted in FIG. 4A, the front surface 102A of the upright wall 102 of the front wall 101 includes a first line 146 (an example of a first mark) and a second line 147 (an example of a second mark).

The first line 146 extends in the left-right direction 9. A position in the up-down direction 7 of the first line 146 is at the same height as a liquid surface of the ink when a maximum permissible amount (an example of a first amount) of ink has been stored in the ink chamber 111, in the usable posture of the multifunction peripheral 10. In other words, the first line 146 is provided at a position corresponding to the liquid surface when ink stored in the ink chamber 111 is of a maximum amount. Note that the position in the up-down direction 7 of the first line 146 is not limited to being at the same height as the liquid surface of the ink when said maximum amount of ink has been stored in the ink chamber 111.

The second line 147 extends in the left-right direction 9. The second line 147 is positioned more downwardly than the first line 146. In detail, a position in the up-down direction 7 of the second line 147 is at the same height as a liquid surface of the ink when an amount less than the above-described maximum amount of ink has been stored in the ink chamber 111, in the usable posture of the multifunction peripheral 10. In the present embodiment, the position in the up-down direction 7 of the second line 147 is at the same height as a liquid surface of the ink when ink of a minimum amount (an example of a second amount) at which replenishment of ink becomes required, has been stored in the ink chamber 111, in the usable posture of the ink tank 100. In other words, the second line 147 is provided at a position corresponding to the liquid surface when ink stored in the ink chamber 111 is of a minimum amount.

As depicted in FIG. 4A, a protrusion 108 is formed in the upper wall 104. The protrusion 108 is configured by a plate section 121 and a rib 122. The plate section 121 has an inclined surface 123 extending upwardly rearward. The rib 122 is disposed so as to link the plate section 121 and the upper wall 104. The rib 122 is formed more frontward than the plate section 121. The rib 122 extends in the front-rear direction 8. The rib 122 is shorter in the left-right direction 9 than the plate section 121. Due to there being such structure, the protrusion 108 bends downwardly by a force in at least one of a rearward or a downward orientation acting on the inclined surface 123.

As depicted in FIG. 4B, a protrusion 109 is formed in the lower wall 105. The protrusion 109 is configured by a plate section 124 and a rib 125. The plate section 124 has an inclined surface 126 extending downwardly rearward. The rib 125 is disposed so as to link the plate section 124 and the lower wall 105. The rib 125 is formed more frontward than the plate section 124. The rib 125 extends in the front-rear direction 8. The rib 125 is shorter in the left-right direction 9 than the plate section 124. Due to there being such structure, the protrusion 109 bends upwardly by a force in at least one of a rearward or an upward orientation acting on the inclined surface 126.

Protrusions 131, 132 are formed in the upper wall 104. The protrusion 131 is formed more frontward than the protrusion 108. The protrusion 132 is formed more rearward than the protrusion 108. The protrusions 131, 132 extend in the left-right direction 9.

A protrusion 133 is formed in the lower wall 105. The protrusion 133 is formed in a sub lower wall 105A. The sub lower wall 105A is formed in a front section of the lower wall 105, and is positioned more upwardly than the lower wall 105.

A protrusion 134 is formed in the lower wall 105. The protrusion 134 is formed more rearward than the protrusion 109. The protrusion 134 extends in the left-right direction 9.

A protrusion 135 is formed in the sub lower wall 105A. The protrusion 135 extends in the left-right direction 9. In the present embodiment, the protrusion 135 extends to right and left from the protrusion 133. A protruding length downward of the protrusion 135 is shorter than a protruding length downward of the protrusion 133. In other words, a protruding tip of the protrusion 135 is positioned more upwardly than a protruding tip of the protrusion 133.

A protrusion 136 is formed in the upper wall 104. The protrusion 136 is formed more rearward than the protrusion 108 and the protrusion 132. The protrusion 136 extends in the front-rear direction 8.

<Ink Chamber 111>

As depicted in FIGS. 4A and 4B, the casing 140 has the ink chamber 111 (an example of a liquid storage chamber) on its inside. The ink chamber 111 is an internal space of the ink tank 100, and has ink stored therein. The ink chamber 111 is demarcated by the front wall 101, the left wall 103, the upper wall 104, the lower wall 105, the rear wall 110, the inner wall 107, the film 142, and the film 143. In other words, the ink chamber 111 is demarcated by the right surface of the tank main body 141 configured by the film 142 and the left surface of the tank main body 141 configured by the left wall 103 and the film 143. The ink chamber 111 is divided into a plurality by the inner wall 107.

In the present embodiment, the right surface of the ink chamber 111 is demarcated by a left surface of the film 142. In other words, all of the right surface of the ink chamber 111 is configured by the film 142. Moreover, the left surface of the ink chamber 111 is demarcated by a right surface of the film 143 and a right surface of the left wall 103. In other words, part of the left surface of the ink chamber 111 is configured by the film 143.

Note that the right surface of the ink chamber 111 may be demarcated by the film 142 and a wall. In other words, it is possible for part of the right surface of the ink chamber 111 to be configured by the film 142. Moreover, the left surface of the ink chamber 111 may be demarcated by the film 143 only. In other words, it is possible for all of the left surface of the ink chamber 111 to be composed by the film 143.

The liquid surface of the ink when the maximum permissible storage amount (an example of a first amount) of ink is stored in the ink chamber 111 in the usable posture of the multifunction peripheral 10, in other words, in a state where the upper wall 104 configures an upper section of the ink tank 100 and the lower wall 105 configures a lower section of the ink tank 100, is at the same height as the first line 146.

The liquid surface of the ink when ink of the minimum amount (an example of a second amount) at which replenishment of ink becomes required, is stored in the ink chamber 111 in the usable posture of the multifunction peripheral 10, in other words, in a state where the upper wall 104 configures the upper section of the ink tank 100 and the lower wall 105 configures the lower section of the ink tank 100, is at the same height as the second line 147.

<Ink Outflow Passage 114>

As depicted in FIG. 4B, the casing 140 includes an ink outflow passage 114. The ink outflow passage 114 is a communicating path for ink stored in the ink chamber 111 to flow out to outside of the ink tank 100.

One end of the ink outflow passage 114 communicates with the ink chamber 111 via an opening 149 and an opening 150 (refer to FIG. 11) formed in a boundary of the lower wall 105 and the rear wall 110. The other end of the ink outflow passage 114 communicates with a protrusion 157 (an example of a liquid supply section) via an opening 156 (refer to FIG. 11) formed in the rear wall 110. The opening 156 is positioned more upwardly than the openings 149, 150.

The protrusion 157 protrudes rearward from a peripheral portion of the opening 156 of the rear surface 110A (an example of a third surface) of the rear wall 110, in other words, to an outer side of the ink tank 100. Now, in a state where the tank set 99 has been installed on the inside of the casing 14 of the multifunction peripheral 10, the rear surface 110A of the rear wall 110 is directed to an inner side of the casing 14. In other words, the protrusion 157 protrudes to the inner side of the casing 14. The protrusion 157 is hollow. A front end of an internal space of the protrusion 157 communicates with the ink outflow passage 114 by the opening 156. A rear end of the internal space of the protrusion 157 communicates with outside of the ink tank 100.

Figure 11:
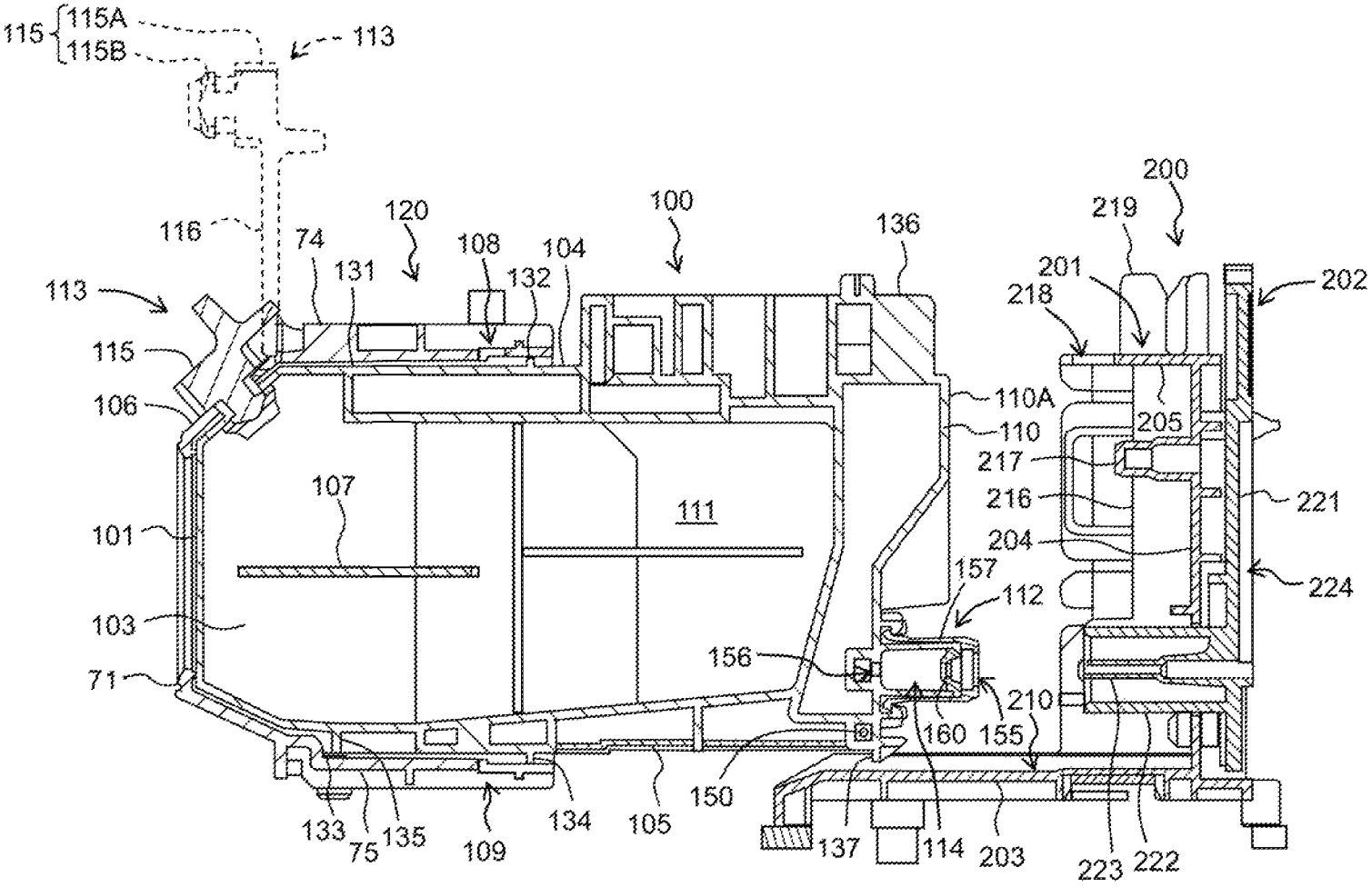
FIG. 11 is a longitudinal cross-sectional view depicting a state before each of the ink tanks held in the holding member is installed in the coupling member.

As depicted in FIG. 11, a seal member 160 is provided in a protruding end of the protrusion 157. The seal member 160 is a disc-shaped member having elasticity, of the likes of rubber. The seal member 160 contacts in a liquid-tight manner the protruding end of the protrusion 157. A through hole is formed in a center of the seal member 160. In a state where the ink tank 100 has been installed on the inside of the casing 14, an ink needle 223 (an example of a tube) of the coupling member 200 is inserted into the through hole of the seal member 160. The ink needle 223 is directly or indirectly connected to the ink tube 32. As a result, ink that has entered the internal space of the protrusion 157 from the ink outflow passage 114 via the opening 156 flows out to the ink tube 32 via the ink needle 223.

A protrusion 137 protruding downwardly from the rear end of the lower wall 105 is formed downwardly of the protrusion 157. The protrusion 137 enters a groove 210 (refer to FIG. 9) when the ink tank 100 is coupled to the coupling member 200.

As described above, the ink stored in the ink chamber 111 communicates with the nozzle 40 of the recording head 39 via the ink outflow passage 114, the internal space of the protrusion 157, the ink needle 223, and the ink tube 32.

<Atmosphere Communication Passage 170>

As depicted in FIG. 4A, the casing 140 has an atmosphere communication passage 170. The atmosphere communication passage 170 communicates the ink chamber 111 and outside of the ink tank 100. In other words, the atmosphere communication passage 170 opens the ink chamber 111 to the atmosphere.

One end of the atmosphere communication passage 170 communicates with the ink chamber 111 via openings 144, 145. The other end of the atmosphere communication passage 170 communicates with an air opening port 187 formed in the upper wall 104.

A semipermeable membrane 183 is attached between the one end and the other end of the atmosphere communication passage 170, so as to block the atmosphere communication passage 170. The semipermeable membrane 183 is a porous membrane having minute holes that block passage of ink and allow passage of a gas. For example, the semipermeable membrane 183 is composed of a fluororesin such as polytetrafluoroethylene, polychlorotrifluoroethylene, tetrafluoroethylene-hexafluoropropylene copolymer, tetrafluoroethylene-perfluoroalkylvinyl ether copolymer, tetrafluoroethylene-ethylene copolymer, and so on. As a result, the ink stored in the ink chamber 111 is blocked by the semipermeable membrane 183 and thereby unable to flow out to outside of the ink tank 100 via the air opening port 187. On the other hand, air can move freely between the inside of the ink chamber 111 and outside of the ink tank 100.

As depicted in FIG. 4B, a labyrinth 179 is formed between a position where the semipermeable membrane 183 in the atmosphere communication passage 170 is attached and the air opening port 187. The labyrinth 179 is a communicating path that, by a plurality of separating walls 186 that extend in the up-down direction 7 being provided aligned in the front-rear direction 8, extends along the front-rear direction 8 while repeating U-turns in the up-down direction 7.

<Inlet 112>

Figure 5A:
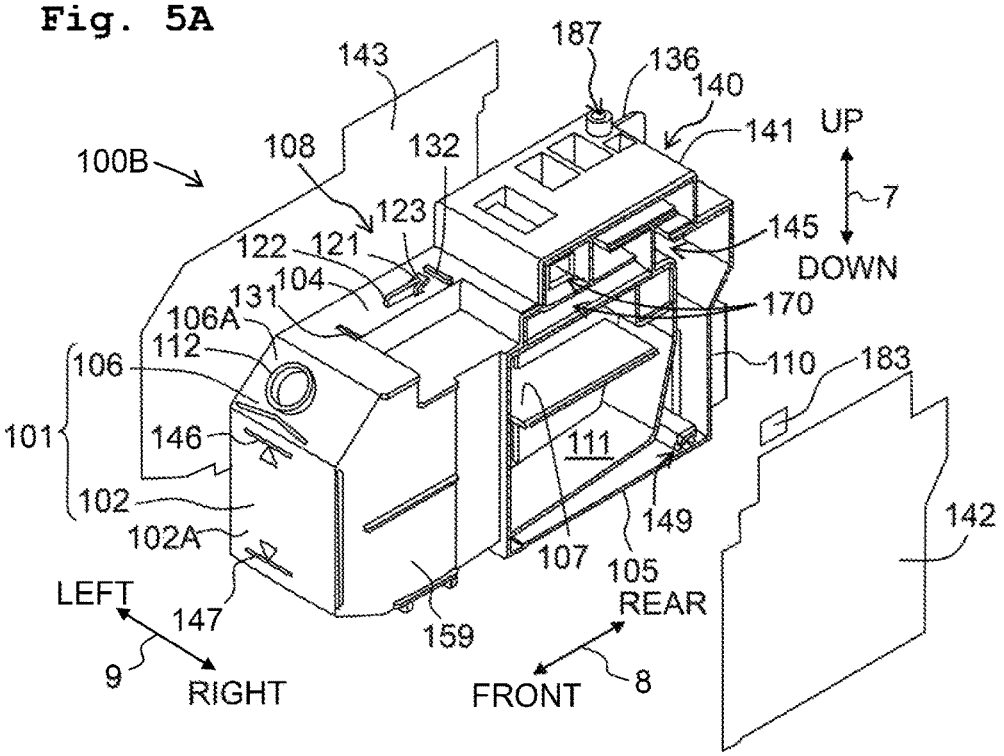
FIG. 5A is a front perspective view of an ink tank for a black ink.

As depicted in FIGS. 4A and 5A, an inlet 112 for filling ink into the ink chamber 111 is formed in each of the inclined walls 106 of the ink tanks 100B, 100Y, 100C, 100M. The inlet 112 penetrates the inclined wall 106 in a thickness direction to communicate the ink chamber 111 with outside of the ink tank 100.

The inclined wall 106 and the inlet 112 are exposed to outside of the multifunction peripheral 10 via the opening 22, by the cover 70 being positioned in the open position. A posture (filling posture) of the ink tank 100 when ink is filled into the ink chamber 111 via the inlet 112, is the usable posture. That is, ink is filled into the ink chamber 111 via the inlet 112 when the ink tank 100 is in the usable posture.

<Ink Tank 100B>

Figure 5B:
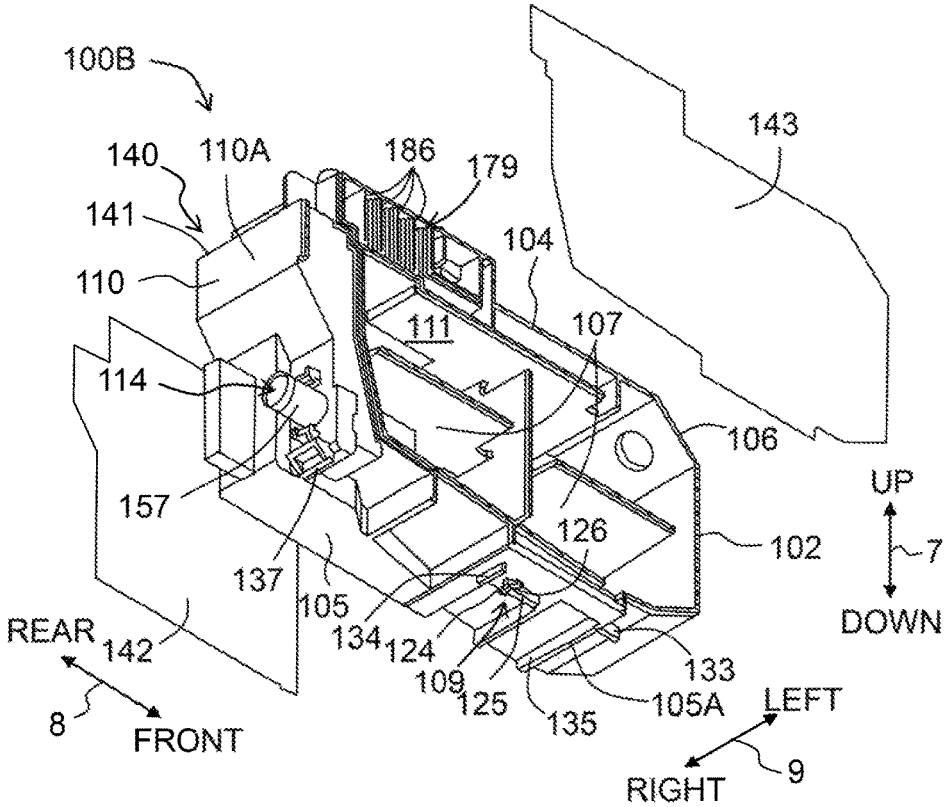
FIG. 5B is a rear perspective view of the ink tank for the black ink.

The structure of the ink tank 100B will be described below with reference to FIGS. 5A and 5B. As depicted in FIGS. 5A and 5B, the ink tank 100B is longer in the left-right direction 9 than the ink tanks 100Y, 100C, 100M (refer to FIGS. 4A and 4B).

Portions different from the ink tanks 100Y, 100C, 100M, of the ink tank 100B will be described below. Note that portions having the same structure as in the ink tanks 100Y, 100C, 100M in the ink tank 100B will be assigned with the same reference symbols as in FIGS. 4A and 4B, whereupon descriptions thereof will be omitted. Moreover, in the case that structure of a certain portion in the ink tank 100B differs from structure of a portion corresponding to said certain portion of the ink tanks 100Y, 100C, 100M only in being longer in the left-right direction 9 than the structure of the portion corresponding to said certain portion of the ink tanks 100Y, 100C, 100M, the portion corresponding to said certain portion in the ink tank 100B will be assigned with the same reference symbol as in FIGS. 4A and 4B, whereupon a description thereof will be omitted.

As depicted in FIGS. 5A and 5B, the ink tank 100B includes a right wall 159, but does not include the left wall 103 (refer to FIG. 4B) which is included in the ink tanks 100Y, 100C, 100M. The right wall 159 extends rearward from a right end of the front wall 101. An upper end of the right wall 159 is connected to a front section of the upper wall 104. A lower end of the right wall 159 is connected to a front section of the lower wall 105. In other words, the right wall 159 joins the right end of the front wall 101, a front section right end of the upper wall 104, and a front section right end of the lower wall 105. In other words, the right wall 159 is provided only in the front section of the tank main body 141, and is not provided in the rear section of the tank main body 141.

<Holding Member 120>

As depicted in FIG. 6, the holding member 120 holds the four ink tanks 100B, 100Y, 100C, 100M, from the front in the front-rear direction 8, in a state of being aligned in the left-right direction 9.

Figure 7A:
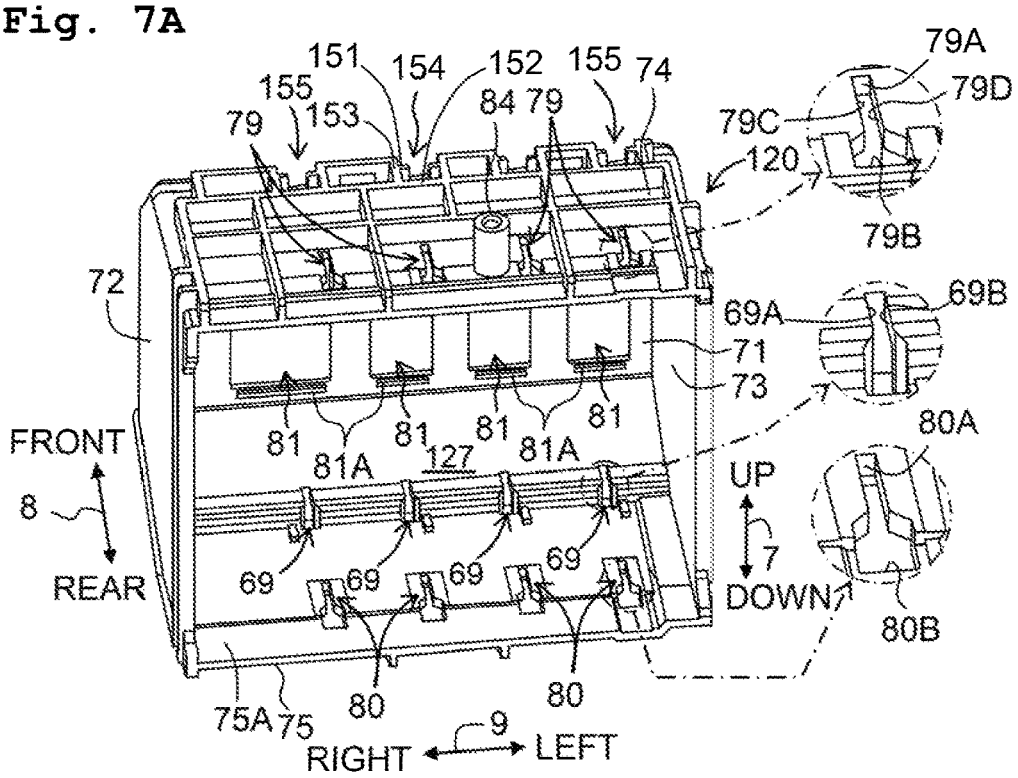
FIG. 7A is an upper side perspective view of a holding member.
Figure 7B:
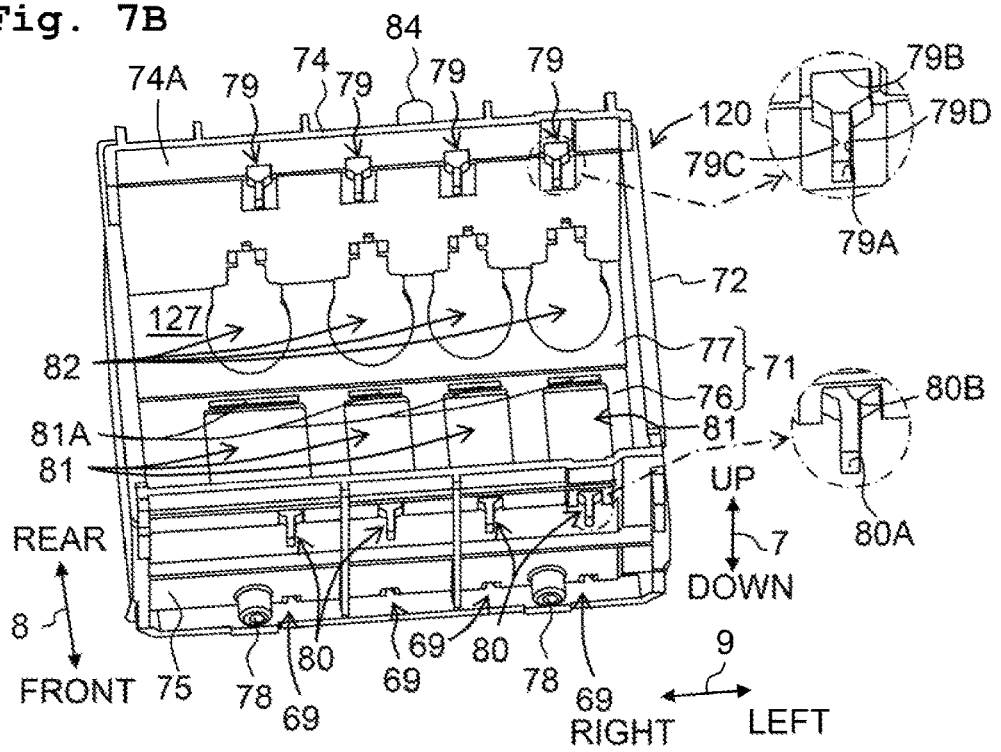
FIG. 7B is a lower side perspective view of the holding member.
Figure 8:
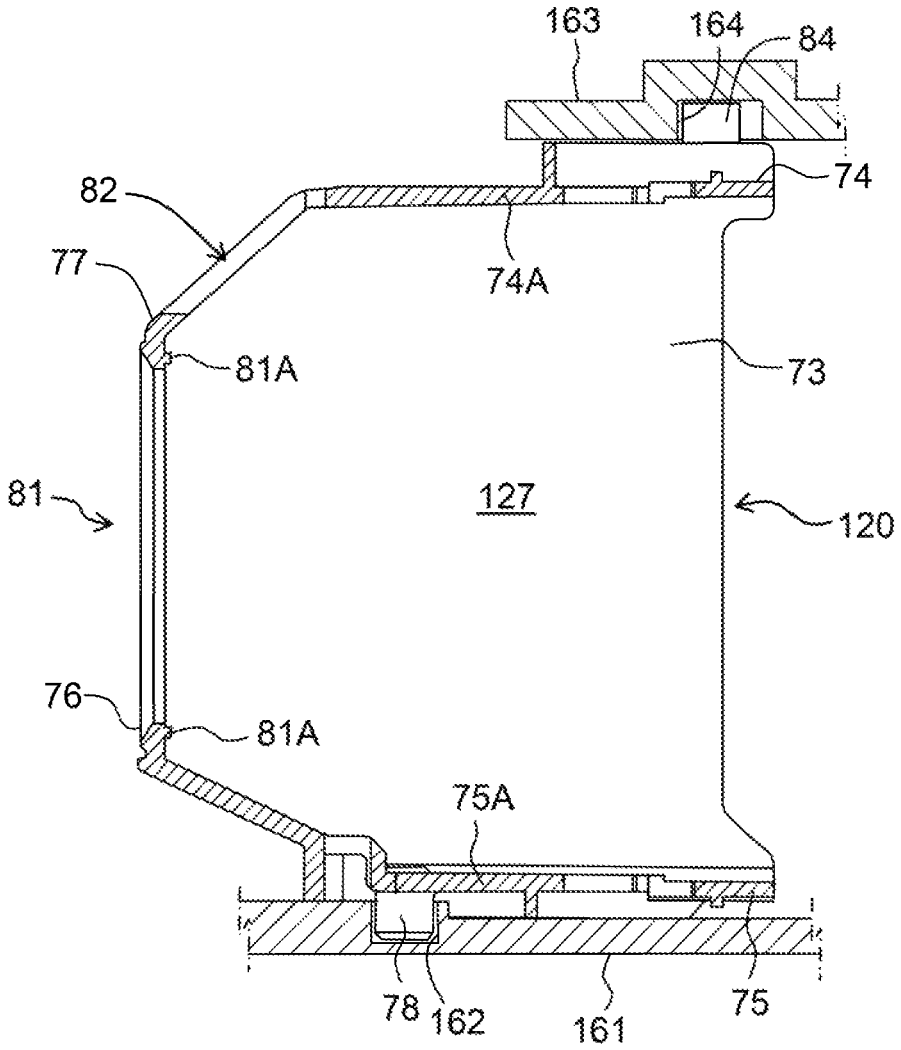
FIG. 8 is a partial longitudinal cross-sectional view of a casing and the holding member.

As depicted in FIGS. 7A, 7B, and 8, the holding member 120 includes a front wall 71, a right wall 72, a left wall 73, an upper wall 74, and a lower wall 75.

The front wall 71 is configured by an upright wall 76 and an inclined wall 77. The upright wall 76 extends in the up-down direction 7 and the left-right direction 9. The inclined wall 77 joins an upper end of the upright wall 76 and a front end of the upper wall 74. The inclined wall 77 inclines in the up-down direction 7 and the front-rear direction 8.

The right wall 72 extends rearward from a right end of the front wall 71. The left wall 73 extends rearward from a left end of the front wall 71. The upper wall 74 extends rearward from an upper end of the front wall 71 (in detail, an upper end of the inclined wall 77). A right end of the upper wall 74 is connected to an upper end of the right wall 72. A left end of the upper wall 74 is connected to an upper end of the left wall 73. The lower wall 75 extends rearward from a lower end of the front wall 71. A right end of the lower wall 75 is connected to a lower end of the right wall 72. A left end of the lower wall 75 is connected to a lower end of the left wall 73.

A downwardly extending protrusion 78 of cylindrical shape is formed in the lower wall 75. The protrusion 78 is formed in each of a right end section and a left end section of the lower wall 75. As depicted in FIG. 8, the protrusion 78 is inserted into a hole 162 formed in a base plate 161 of the casing 14 of the printer unit 11.

An upwardly extending protrusion 84 of cylindrical shape is formed in the upper wall 74. The protrusion 84 is formed close to a center in the left-right direction 9 of the upper wall 74. As depicted in FIG. 8, the protrusion 84 is inserted into a hole 164 formed in an intermediate plate 163 of the casing 14 of the printer unit 11. In this way, the holding member 120 is fixed in and supported by the casing 14 in a state that the holding member 120 holds the ink tank 100.

As depicted in FIGS. 7A and 7B, an internal space 127 of the holding member 120 is formed by the front wall 71, the right wall 72, the left wall 73, the upper wall 74, and the lower wall 75. As depicted in FIG. 6, the four ink tanks 100B, 100Y, 100C, 100M are inserted from the rear toward the internal space 127. As a result, front sections of the four ink tanks 100B, 100Y, 100C, 100M occupy the internal space 127.

As depicted in FIG. 7B, a plurality of openings 79 are formed in a rear section of the upper wall 74. The plurality of openings 79 respectively correspond to the four ink tanks 100B, 100Y, 100C, 100M. In other words, in the present embodiment, four of the openings 79 are formed. Each of the openings 79 is formed in a position corresponding to the protrusion 108 (refer to FIGS. 4A and 5A) of each of the ink tanks 100, in a state where each of the ink tanks 100 has been inserted into the internal space 127.

As depicted in FIG. 7A, a plurality of openings 80 are formed in a rear section of the lower wall 75. The plurality of openings 80 respectively correspond to the four ink tanks 100B, 100Y, 100C, 100M. In other words, in the present embodiment, four of the openings 80 are formed. Each of the openings 80 is formed in a position corresponding to the protrusion 109 (refer to FIGS. 4B and 5B) of each of the ink tanks 100, in a state where each of the ink tanks 100 has been inserted into the internal space 127.

A plurality of openings 69 are formed in the lower wall 75. The plurality of openings 69 respectively correspond to the four ink tanks 100B, 100Y, 100C, 100M. In other words, in the present embodiment, four of the openings 69 are formed. The four openings 69 are each formed more frontward than the four openings 80. Each of the openings 69 extends in the front-rear direction 8. Each of the openings 69 is formed in a position corresponding to the protrusion 133 (refer to FIGS. 4B and 5B) of each of the ink tanks 100, in a state where each of the ink tanks 100 has been inserted into the internal space 127.

In a process of the ink tank 100 being inserted into the internal space 127, the plate section 121 of the protrusion 108 is pressed by abutting on a lower surface 74A of the upper wall 74 and thereby bends downwardly. Moreover, the plate section 124 of the protrusion 109 is pressed by abutting on an upper surface 75A of the lower wall 75 and thereby bends upwardly. When the ink tank 100 is further inserted, the rib 122 and the plate section 121 are inserted into the opening 79. Moreover, the rib 125 and the plate section 124 are inserted into the opening 80. As a result, bending of the protrusions 108, 109 is released. The ink tank 100 is slightly movable in the up-down direction 7 in a range of bending of the protrusions 108, 109, in the internal space 127 of the holding member 120.

In this state, the protrusion 108 engages with the opening 79 and the protrusion 109 engages with the opening 80. The protrusion 108 and the protrusion 109 are examples of an engaging section. Moreover, the opening 79 and the opening 80 are examples of an engaged section and a first engaging section.

In an engaged state of the protrusion 108 and the opening 79, if the ink tank 100 attempts to move frontward with respect to the holding member 120, the protrusion 108 abuts on a front edge surface 79A demarcating a front end of the opening 79. As a result, movement frontward with respect to the holding member 120 of the ink tank 100 is restricted. Moreover, in an engaged state of the protrusion 108 and the opening 79, if the ink tank 100 attempts to move rearward with respect to the holding member 120, the protrusion 108 abuts on a rear edge surface 79B demarcating a rear end of the opening 79. As a result, movement rearward with respect to the holding member 120 of the ink tank 100 is restricted. However, in the front-rear direction 8, an outer shape of the opening 79 is slightly larger than an outer shape of the protrusion 108. Therefore, in an engaged state of the protrusion 108 and the opening 79, the ink tank 100 can be moved slightly in the front-rear direction 8 with respect to the holding member 120.

In an engaged state of the protrusion 109 and the opening 80, if the ink tank 100 attempts to move frontward with respect to the holding member 120, the protrusion 109 abuts on a front edge surface 80A demarcating a front end of the opening 80. As a result, movement frontward with respect to the holding member 120 of the ink tank 100 is restricted. Moreover, in an engaged state of the protrusion 109 and the opening 80, if the ink tank 100 attempts to move rearward with respect to the holding member 120, the protrusion 109 abuts on a rear edge surface 80B demarcating a rear end of the opening 80. As a result, movement rearward with respect to the holding member 120 of the ink tank 100 is restricted. However, in the front-rear direction 8, an outer shape of the opening 80 is slightly larger than an outer shape of the protrusion 109. Therefore, in an engaged state of the protrusion 109 and the opening 80, the ink tank 100 can be moved slightly in the front-rear direction 8 with respect to the holding member 120.

As described above, by the protrusion 108 abutting against an edge surface of the opening 79 and the protrusion 109 abutting against an edge surface of the opening 80, the ink tank 100 is positioned so as to be slightly movable in the front-rear direction 8.

Moreover, in a state where the protrusion 108 and opening 79 are engaged and the protrusion 109 and opening 80 are engaged, the protrusions 131, 132 abut against the lower surface 74A of the upper wall 74, and the protrusions 134, 135 abut against the upper surface 75A of the lower wall 75. As a result, the ink tank 100 is positioned in the up-down direction 7. However, there is a gap of substantially a tolerance portion between the protrusions 131, 132 and the lower surface 74A, and moreover, there is a gap of substantially a tolerance portion between the protrusions 134, 135 and the upper surface 75A. Therefore, the ink tank 100 is positioned so as to be slightly movable in the up-down direction 7, by the holding member 120.

Moreover, in a state where the protrusion 108 and opening 79 are engaged and the protrusion 109 and opening 80 are engaged, the rib 122 is inserted into the opening 79. In an inserted state of the rib 122 into the opening 79, if the ink tank 100 attempts to move rightwards with respect to the holding member 120, the rib 122 abuts against a right edge surface 79C demarcating a right end of the opening 79. Moreover, in an inserted state of the rib 122 into the opening 79, if the ink tank 100 attempts to move leftwards with respect to the holding member 120, the rib 122 abuts against a left edge surface 79D demarcating a left end of the opening 79. However, in the left-right direction 9, an outer shape of the opening 79 is slightly larger than an outer shape of the rib 122. Therefore, in an engaged state of the rib 122 and the opening 79, the ink tank 100 can be moved slightly in the left-right direction 9 with respect to the holding member 120.

Moreover, in a state where the protrusion 108 and opening 79 are engaged and the protrusion 109 and opening 80 are engaged, the protrusion 133 is inserted into the opening 69. In an inserted state of the protrusion 133 into the opening 69, if the ink tank 100 attempts to move rightwards with respect to the holding member 120, the protrusion 133 abuts against a right edge surface 69A demarcating a right end of the opening 69. Moreover, in an inserted state of the protrusion 133 into the opening 69, if the ink tank 100 attempts to move leftwards with respect to the holding member 120, the protrusion 133 abuts against a left edge surface 69B demarcating a left end of the opening 69. However, in the left-right direction 9, an outer shape of the opening 69 is slightly larger than an outer shape of the protrusion 133. Therefore, in an engaged state of the protrusion 133 and the opening 69, the ink tank 100 can be moved slightly in the left-right direction 9 with respect to the holding member 120. In this case, each of the edge surfaces 69A, 69B of the opening 69 is an example of an abutting section.

As described above, by the rib 122 abutting against an edge surface of the opening 79 and the protrusion 133 abutting against an edge surface of the opening 69, the ink tank 100 is positioned so as to be slightly movable in the left-right direction 9 with respect to the holding member 120. The openings 79, 69 are examples of a first engaging section.

Figure 10:
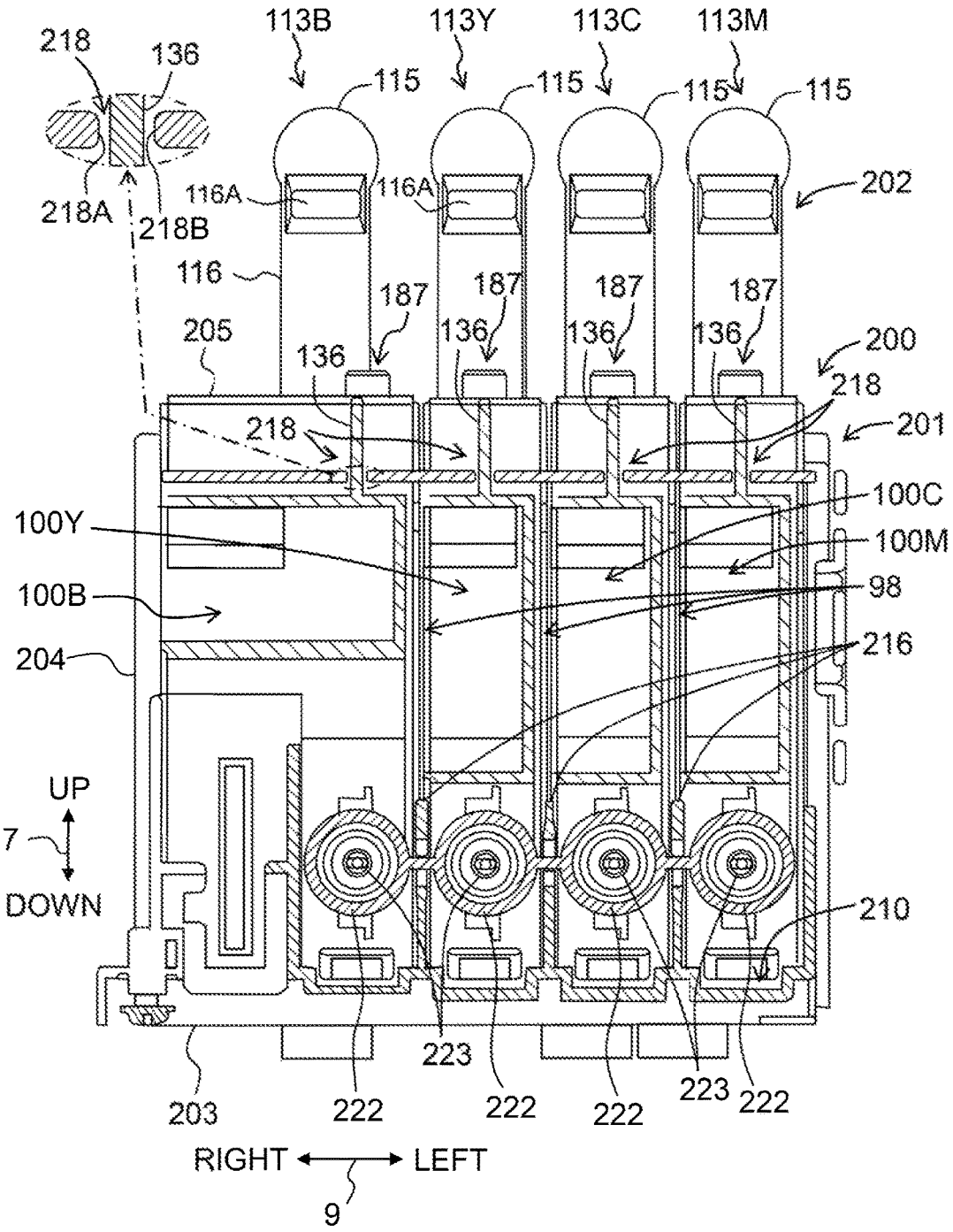
FIG. 10 is a longitudinal cross-sectional view of the coupling member.

As depicted in FIG. 6, in a positioned state in the left-right direction 9, a gap 98 is formed between adjacent ink tanks 100. As described above, the holding member 120 holds the four ink tanks 100B, 100Y, 100C, 100M in a state of being aligned in the left-right direction 9, as depicted in FIG. 10. Note that an arrangement order of the ink tanks 100 is, in order from the right, the ink tank 100B, the ink tank 100Y, the ink tank 100C, and the ink tank 100M.

As depicted in FIG. 11, in a state of the holding member 120 holding the ink tank 100, the front wall 71 covers the front wall 101 of the ink tank 100, the upper wall 74 covers a front section of the upper wall 104 of the ink tank 100, and the lower wall 75 covers a front section of the lower wall 105 of the ink tank 100.

Moreover, in a state of the holding member 120 holding the ink tank 100, the right wall 72 covers a front section of a right surface (the right wall 159) of the ink tank 100B disposed most rightwards of the four ink tanks 100, and the left wall 73 covers a front section of a left surface (the left wall 103) of the ink tank 100M disposed most leftwards of the four ink tanks 100. In other words, the holding member 120 covers parts of surfaces positioned on an outer side in the left-right direction 9, of the right surface and left surface of the ink tanks 100B, 100M positioned on left and right both ends of the held plurality of ink tanks 100 (a part of the right surface of the ink tank 100B and a part of the left surface of the ink tank 100M).

As described above, the holding member 120 in a state of holding the ink tank 100 covers the front section of the ink tank 100.

As depicted in FIG. 7B, a plurality of openings 81 is formed in the upright wall 76 of the front wall 71 of the holding member 120. The plurality of openings 81 are formed at intervals in the left-right direction 9. The plurality of openings 81 respectively correspond to the four ink tanks 100B, 100Y, 100C, 100M. In other words, in the present embodiment, four of the openings 81 are formed. In the present embodiment, a shape of each of the openings 81 is a rectangle, but may be other than a rectangle.

As depicted in FIG. 11, in a state of the holding member 120 holding each of the ink tanks 100, the upright wall 102 of the front wall 101 of each of the ink tanks 100 is exposed to outside of the holding member 120 via the opening 81. In detail, the front surface 102A of the upright wall 102 and the first line 146 and second line 147 formed on said front surface 102A, are exposed. Moreover, as depicted in FIG. 1A, in a state of the holding member 120 holding each of the ink tanks 100 and a state of the cover 70 being in the closed position, the upright wall 102 of each of the ink tanks 100 is exposed to outside of the printer unit 11 via the opening 81 of the holding member 120 and the opening 97 of the cover 70.

A protrusion 81A (an example of an abutting section) that protrudes toward the internal space 127 of the holding member 120 is formed in each of an upper and a lower portion of a peripheral edge of each of the openings 81. In a state of the holding member 120 holding each of the ink tanks 100, the upright wall 102 of the front wall 101 of each of the ink tanks 100 abuts against the protrusion 81A of the peripheral edge of the opening 81. As a result, a frontward position of each of the ink tanks 100 is determined with respect to the holding member 120.

As depicted in FIG. 7B, a plurality of openings 82 are formed in the inclined wall 77 of the front wall 71 of the holding member 120. The plurality of openings 82 are formed at intervals in the left-right direction 9. The plurality of openings 82 respectively correspond to the four ink tanks 100B, 100Y, 100C, 100M. In other words, in the present embodiment, four of the openings 82 are formed. In the present embodiment, a shape of each of the openings 82 is a circle, but may be other than a circle.

As depicted in FIG. 11, in a state of the holding member 120 holding each of the ink tanks 100, the inlet 112 of each of the ink tanks 100 is exposed to outside of the holding member 120 via the opening 82.

As depicted in FIG. 7A, a cap attachment section 155 to which a later-mentioned cap 113 is attached, is formed in a front section of the upper wall 74 of the holding member 120.

In the present embodiment, as depicted in FIG. 7A, the cap attachment section 155 is demarcated by ribs 151, 152 extending in the left-right direction 9 and a plurality of ribs 153 extending in the front-rear direction 8. The rib 152 is formed rearward of the rib 151. A gap 154 is formed in a plurality of places of the rib 151. Each of the gaps 154 is formed rearward of each of the openings 82. A position in the left-right direction 9 of each of the gaps 154 is the same as a position in the left-right direction 9 of each of the openings 82. Each of the ribs 153 connects the rib 151 and the rib 152. Each of the ribs 153 is formed on both outer sides in the left-right direction 9 of each of the gaps 154.

Note that provided the cap attachment section 155 has structure enabling the cap 113 to be attached, it is not limited to the previously mentioned structure including the ribs 151, 152, 153.

<Coupling Member 200>

As depicted in FIG. 6, the coupling member 200 holds the four ink tanks 100B, 100Y, 100C, 100M, from the rear, in a state of being aligned in the left-right direction 9. The coupling member 200 has a supporting main body 201 and a coupling section 202. As depicted in FIG. 9, the coupling member 200 is configured by the coupling section 202 being combined from a rear of the supporting main body 201. Note that in the present embodiment, the supporting main body 201 and the coupling section 202 are configured as separate members, but the supporting main body 201 and the coupling section 202 may be formed integrally.

Figure 9A:
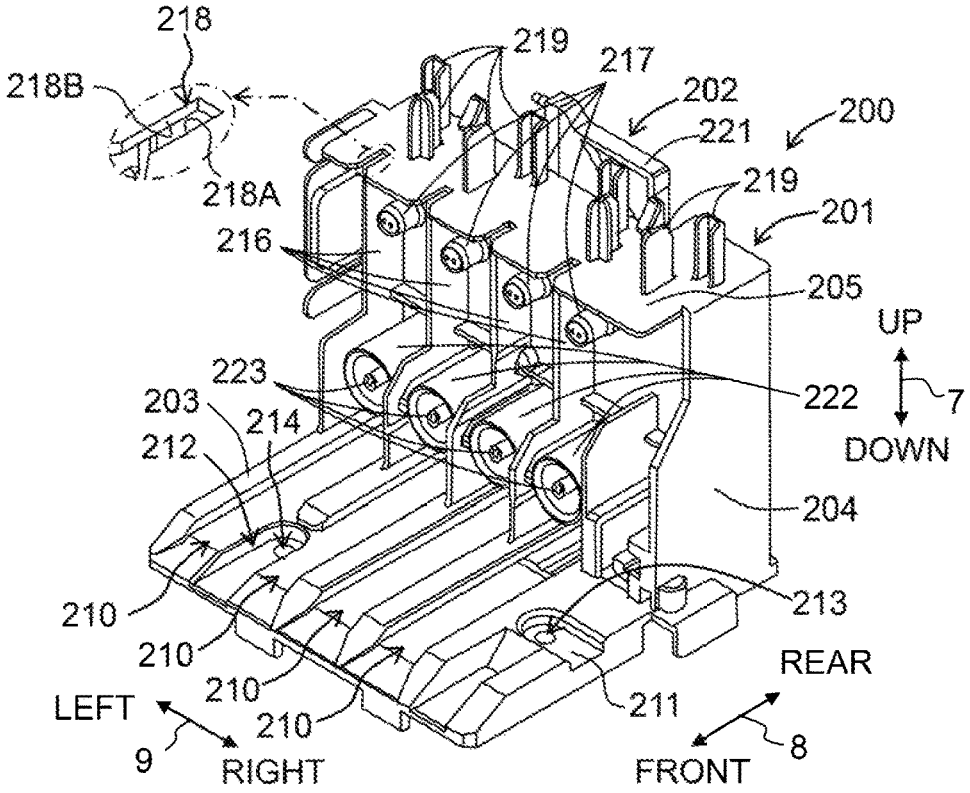
FIG. 9A is a front perspective view of a coupling member.
Figure 9B:
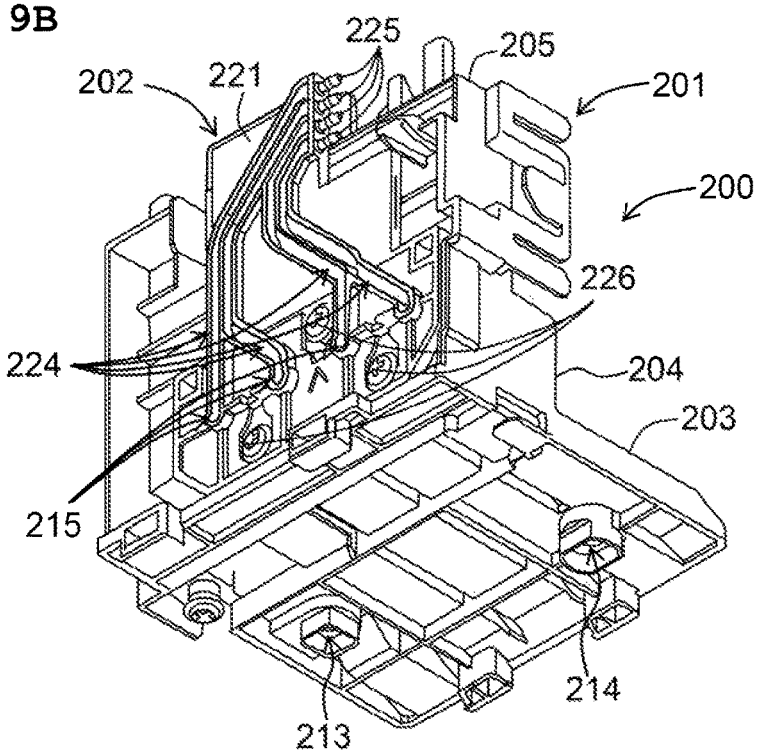
FIG. 9B is a rear perspective view of the coupling member.

As depicted in FIGS. 9A and 9B, the supporting main body 201 has a base section 203, a standing section 204, and a ceiling section 205. The standing section 204 rises upwardly from a rear end section of the base section 203. The ceiling section 205 extends frontward from an upper end section of the standing section 204.

The base section 203 is a roughly rectangular flat plate. Four grooves 210 extending in the front-rear direction 8 are formed in an upper surface of the base section 203. A front end of each of the grooves 210 opens frontward. Widths in the left-right direction 9 of each of the grooves 210 are slightly larger than widths in the left-right direction 9 of each of the ink tanks 100. When the four ink tanks 100B, 100Y, 100C, 100M integrally held in the holding member 120 are coupled to the coupling member 200, the protrusions 137 of each of the ink tanks 100 (refer to FIGS. 4B and 5B) enter each of the grooves 210. As a result, each of the ink tanks 100 is guided sliding in the front-rear direction 8, while being positioned in the left-right direction 9.

Two recesses 211, 212 are formed in the base section 203 at positions not overlapping the groove 210. The recesses 211, 212 are disposed at positions separated in the left-right direction 9. Through holes 213, 214 penetrating the base section 203 in the up-down direction 7 are respectively formed in the recesses 211, 212. Screws inserted in the through holes 213, 214 are screwed into screw holes of the casing 14 and heads of the screws abut against the recesses 211, 212, whereby the base section 203 is fixed to and supported by the casing 14.

The standing section 204 has a width in the left-right direction 9 which is substantially the same as a width in the left-right direction 9 of the base section 203. An opening 215 (refer to FIG. 6) penetrating in the front-rear direction 8 is formed in the standing section 204 at a position corresponding to a rear end of each of the grooves 210. A guide tube 222 of the coupling section 202 protrudes frontward from a rear of the standing section 204, via the opening 215.

A partition plate 216 extending in the up-down direction 7 is provided between each of the openings 215, in the left-right direction 9. Each of the partition plates 216 suppresses ink scattering and being attached between adjacent ink needles 223 of the coupling section 202.

Rods 217 protruding frontward are respectively provided upwardly of each of the openings 215. The rear wall 110 of each of the ink tanks 100 abuts against a front end of each of the rods 217, whereby a rearward position of each of the ink tanks 100 is determined.

The ceiling section 205 has a width in the left-right direction 9 which is substantially the same as a width in the left-right direction 9 of the standing section 204. An opening 218 (an example of a second engaging section) penetrating the ceiling section 205 in the up-down direction 7 extends rearward at a tip of the ceiling section 205, upwardly of each of the grooves 210.

As depicted in FIG. 10, in a state where the ink tanks 100B, 100Y, 100C, 100M have been coupled to the coupling member 200, the protrusion 136 of the ink tanks 100B, 100Y, 100C, 100M is inserted into the opening 218. In an inserted state of the protrusion 136 into the opening 218, if the ink tank 100 attempts to move rightwards with respect to the coupling member 200, the protrusion 136 abuts against a right edge surface 218A demarcating a right end of the opening 218. Moreover, in an inserted state of the protrusion 136 into the opening 218, if the ink tank 100 attempts to move leftwards with respect to the coupling member 200, the protrusion 136 abuts against a left edge surface 218B demarcating a left end of the opening 218. However, in the left-right direction 9, an outer shape of the opening 218 is slightly larger than an outer shape of the protrusion 136. Therefore, in an engaged state of the protrusion 136 and the opening 218, the ink tank 100 can be moved slightly in the left-right direction 9 with respect to the coupling member 200.

A plurality of protrusions 219 protrude upwardly on an upper surface of the ceiling section 205. Although not depicted in the drawings, each of the protrusions 219 engages with the intermediate plate 163 of the casing 14, whereby the coupling member 200 is positioned with respect to the casing 14.

As depicted in FIGS. 9A and 9B, the coupling section 202 has a coupling plate 221, the guide tube 222, the ink needle 223, an ink flow path 224, and a joint 225.

The coupling plate 221 has a flat plate shape whose width in the left-right direction 9 is narrower than that of the standing section 204. The coupling plate 221 is fixed to the standing section 204 by a screw 226. As a result, the supporting main body 201 and the coupling section 202 are integrally fixed.

The guide tube 222 has a cylindrical shape protruding frontward from the coupling plate 221. The guide tube 222 extends, upwardly of the groove 210, from rearward of the standing section 204, via the opening 215 of the standing section 204. Four of the guide tubes 222 are disposed aligned in the left-right direction 9 respectively corresponding to the four grooves 210. Each of the guide tubes 222 is capable of housing in its internal space the protrusion 157 of each of the ink tanks 100. When each of the ink needles 223 is inserted into the through hole of the seal member 160 of each of the ink tanks 100, each of the guide tubes 222 houses each of the protrusions 157. As a result, each of the ink needles 223 and the through hole of the seal member 160 are positioned.

The ink needle 223 is disposed in the internal space of each of the guide tubes 222 so as to be coaxial with the guide tube 222. The ink needle 223 is a tube protruding frontward from the coupling plate 221. A front end of the ink needle 223 is in substantially the same position as a front end of the guide tube 222. By the ink needle 223 being inserted into the through hole of the seal member 160 of the ink tank 100, the front end of the ink needle 223 enters the ink outflow passage 114. As a result, the internal space of the ink needle 223 and the ink outflow passage 114 communicate. A rear end of the ink needle 223 opens to a rear surface of the coupling plate 221.

Four of the ink flow paths 224 are formed on the rear surface of the coupling plate 221. The four ink flow paths 224 are configured as independent flow paths respectively corresponding to the four ink needles 223. An opening surface (rear surface) formed in the rear surface of the coupling plate 221 is sealed by an unillustrated film, whereby the ink flow path 224 is formed. Each of the ink flow paths 224 is continuous with an opening at the rear end of each of the ink needles 223. Moreover, the four ink flow paths 224 are respectively continuous with four of the joints 225 formed in an upper section of the coupling plate 221. The four ink tubes 32 are respectively coupled to the four joints 225. An ink flow path communicating from the ink outflow passage 114 of each of the ink tanks 100 to each of the ink tubes 32 is configured by the coupling section 202.

<Cap 113>

As depicted in FIGS. 6 and 10, the ink tank 100 includes caps 113B, 113Y, 113C, 113M (these are sometimes collectively described as "cap 113"). The ink tank 100 includes the four caps 113B, 113Y, 113C, 113M corresponding to the four inlets 112B, 112Y, 112C, 112M of the ink tank 100.

Each of the caps 113 is molded by a material capable of elastic deformation in the manner of rubber or an elastomer. Each of the caps 113 includes a cap section 115, an elastic deformation section 116, and an attaching section 117. Note that structure of each of the caps 113 is not limited to structure described below.

The cap section 115 has an outer shape of a protrusion 115B protruding from a center of a roughly disc shaped disc section 115A.

The elastic deformation section 116 is strip shaped. One end of the elastic deformation section 116 is connected to the cap section 115. The other end of the elastic deformation section 116 is connected to the attaching section 117. The elastic deformation section 116, in a state of not being applied with a force from outside, is in a state of extending roughly straight, as depicted in FIG. 6. A protrusion 116A is formed in the one end of the elastic deformation section 116. The protrusion 116A protrudes contrarily to the cap section 115, sandwiching the elastic deformation section 116 between itself and the cap section 115.

The attaching section 117 has an outer shape of a protrusion 117B protruding from a roughly parallelepiped shaped rectangular section 117A. A boundary of the rectangular section 117A and the protrusion 117B is fastened. The protrusion 117B has a shape corresponding to a shape of the cap attachment section 155 (a region demarcated by the ribs 151, 152, 153). In other words, the protrusion 117B is capable of being fitted to the cap attachment section 155. Moreover, in a fitted state of the protrusion 117B and the cap attachment section 155, the boundary of the rectangular section 117A and the protrusion 117B enters the gap 154.

That is, the cap 113 is attached to the holding member 120 by fitting of the protrusion 117B and the cap attachment section 155.

The cap 113, in a state of having been attached to the holding member 120, is movable to a sealing position depicted by solid lines of FIG. 11 and a separated position depicted by broken lines of FIG. 11. The cap 113 in the sealing position seals the inlet 112 in a liquid-tight manner by the protrusion 115B of the cap section 115 closely contacting a wall surface demarcating a peripheral edge of the inlet 112. In a state of the cap 113 being positioned in the sealing position, the elastic deformation section 116 is curved in a circular arc shape. In a state of the cap 113 being positioned in the separated position, the cap section 115 is separated from the inlet 112. As a result, the inlet 112 is opened. This makes it possible for ink to be filled into the ink chamber 111 via the inlet 112. In a state of the cap 113 being positioned in the separated position, the elastic deformation section 116 undergoes elastic recovery to extend roughly straight.

Figure 14:
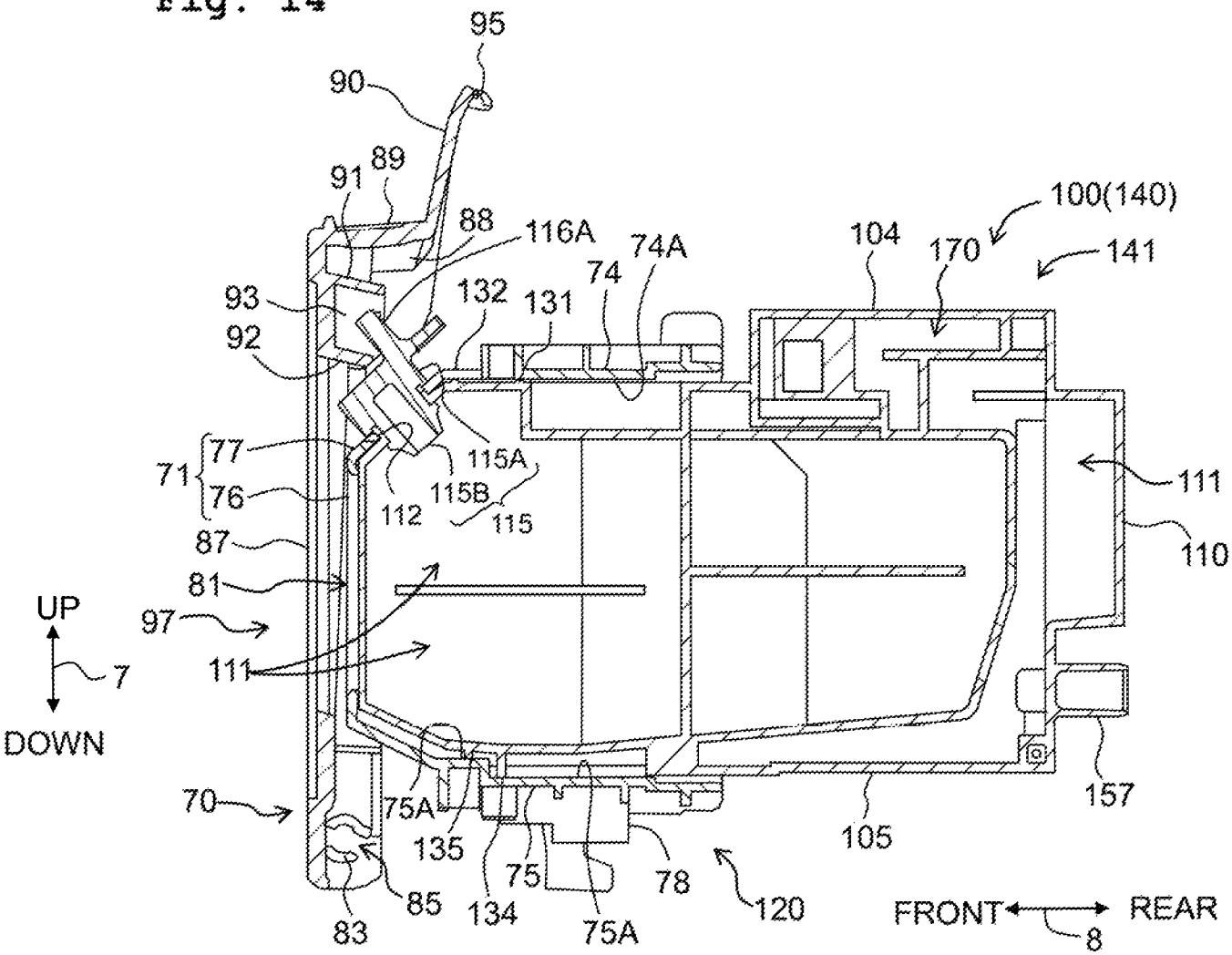
FIG. 14 is a longitudinal cross-sectional view of the ink tank, the holding member, and the cover.

As depicted in FIG. 14, when the cover 70 has been pivoted to the closed position in a state of the cap 113 being positioned in the sealing position, the ribs 93 formed in the cover 70 are positioned between the protrusions 116A of the cap sections 115 of adjacent caps 113, in the left-right direction 9. In other words, parts of the ribs 93 and the protrusions 116A overlap when viewed along the left-right direction 9.

Moreover, when the cover 70 has been pivoted to the closed position in a state of the cap 113 being positioned in the sealing position, the second wall 92 formed in the cover 70 is positioned in an upward vicinity of the disc section 115A of the cap section 115. As a result, the disc section 115A abuts against the second wall 92, and the cap 113 cannot move from the sealing position to the separated position. In other words, the second wall 92 restricts movement from the sealing position of the cap 113.

<Method for Installing Tank Set 99>

A method by which the tank set 99 is installed in the casing 14 will be described below. The coupling member 200 is fixed to the casing 14 beforehand by screws. The ink tanks 100B, 100Y, 100C, 100M are assembled in the coupling member 200 in an integrated state after having been installed in the holding member 120.

As depicted in FIG. 11, the ink tanks 100B, 100Y, 100C, 100M are installed in the holding member 120. As previously mentioned, by engagement of the holding member 120 and the ink tanks 100B, 100Y, 100C, 100M, specifically, by engagement of the protrusion 108 and the opening 79, engagement of the protrusion 109 and the opening 80, engagement of the rib 122 and the opening 79, and engagement of the protrusion 133 and the opening 69, the ink tanks 100B, 100Y, 100C, 100M are positioned slightly movably in the up-down direction 7, the front-rear direction 8, and the left-right direction 9, with respect to the holding member 120. Moreover, the gap 98 is formed between each of the ink tanks 100B, 100Y, 100C, 100M installed in the holding member 120, and mutual contact of each of the ink tanks 100B, 100Y, 100C, 100M is suppressed.

The ink tanks 100B, 100Y, 100C, 100M installed in the holding member 120 are assembled in the coupling member 200 from frontward of the coupling member 200. At this time, the protrusion 137 of the ink tanks 100B, 100Y, 100C, 100M enters the groove 210 of the coupling member 200. As a result, while the ink tanks 100B, 100Y, 100C, 100M are guided rearward along the groove 210, the protrusion 157 of the ink tanks 100B, 100Y, 100C, 100M and the guide tube 222 and ink needle 223 of the coupling member 200 face each other.

Figure 12:
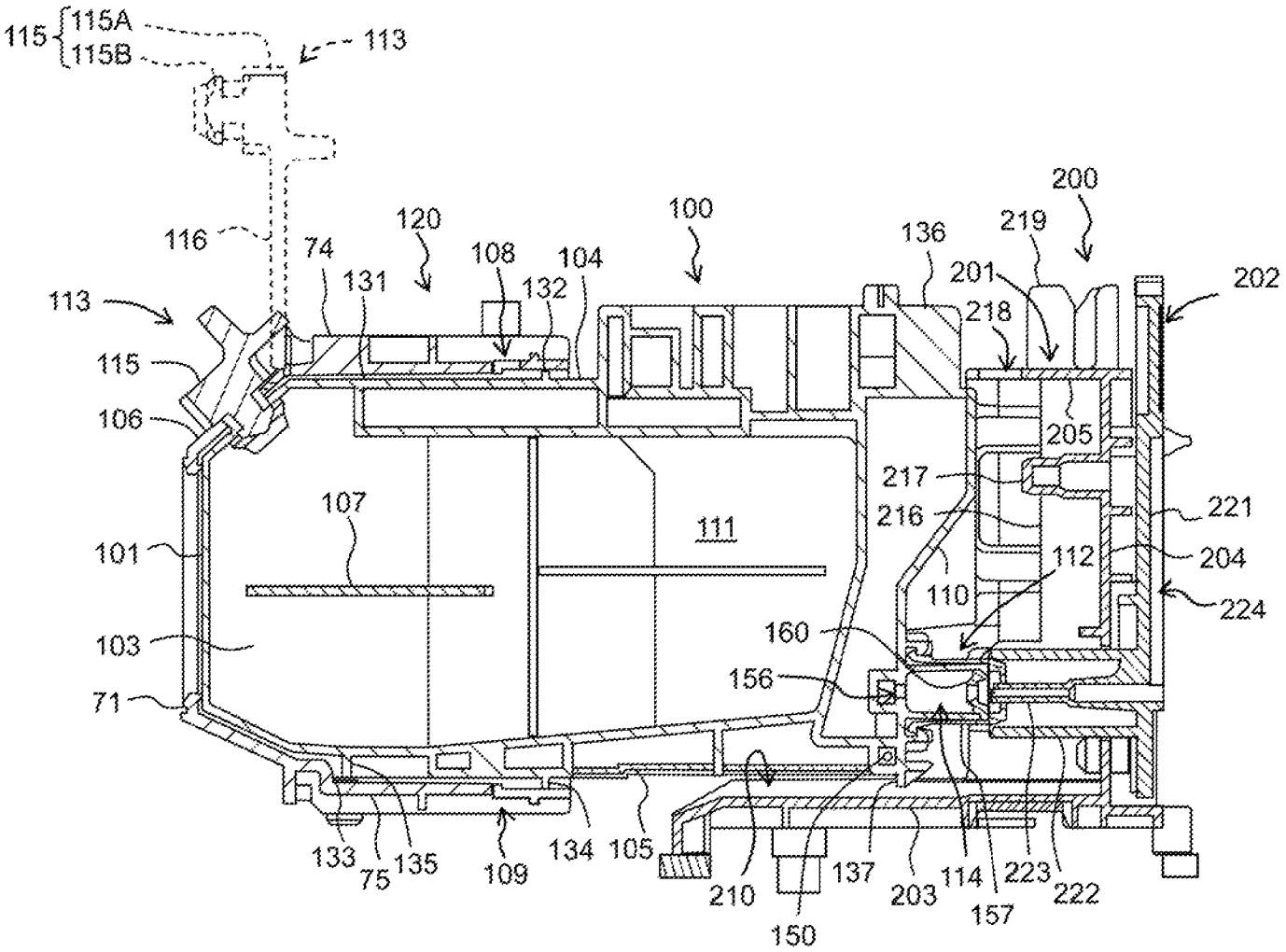
FIG. 12 is a longitudinal cross-sectional view depicting a state when each of the ink tanks held in the holding member is installed in the coupling member.

As depicted in FIG. 12, when the ink tanks 100B, 100Y, 100C, 100M are guided further rearward along the groove 210, the protrusion 157 enters the internal space of the guide tube 222. As a result, the through hole of the seal member 160 and the ink needle 223 are positioned substantially coaxially.

Figure 13:
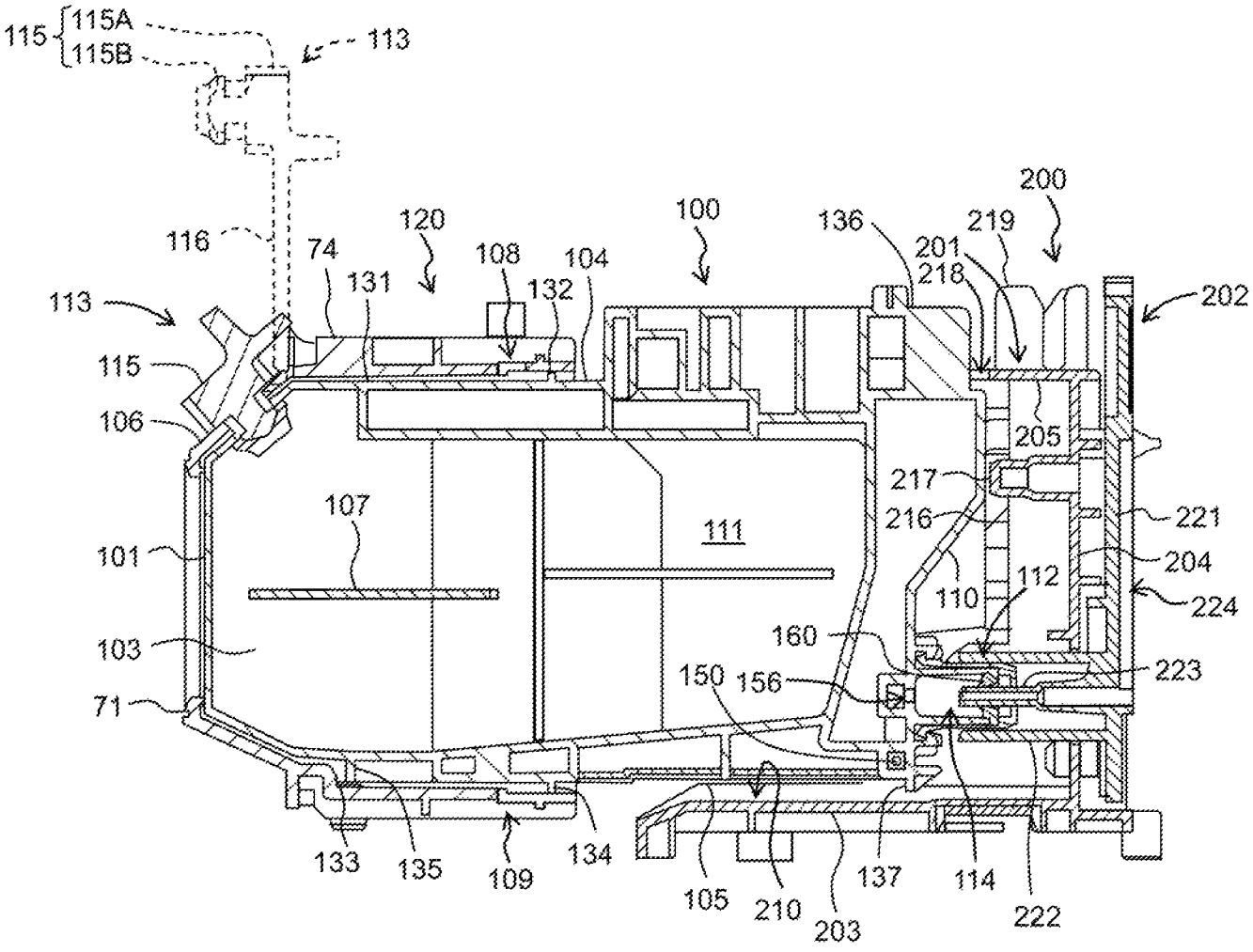
FIG. 13 is a longitudinal cross-sectional view depicting a state where each of the ink tanks held in the holding member has been installed in the coupling member.

As depicted in FIG. 13, when the ink tanks 100B, 100Y, 100C, 100M are moved further rearward, the ink needle 223 enters the through hole of the seal member 160. As a result, the ink outflow passage 114 of the ink tanks 100B, 100Y, 100C, 100M and the internal space of the ink needle 223 communicate. By the rear walls 110 of the ink tanks 100B, 100Y, 100C, 100M respectively abutting against the front ends of the rods 217, the user recognizes that the ink tanks 100B, 100Y, 100C, 100M have been moved to a rearward position. Moreover, as depicted in FIG. 8, by the protrusion 78 being inserted into the hole 162 formed in the base plate 161 of the casing 14 and the protrusion 84 being inserted into the hole 164 formed in the intermediate plate 163 of the casing 14, the holding member 120 is fixed in and supported by the casing 14 in a state of holding the ink tanks 100B, 100Y, 100C, 100M.

Function and Effect of the Embodiment

Due to the present embodiment, in a state of the ink needle 223 having entered the through hole of the seal member 160 of the ink tanks 100B, 100Y, 100C, 100M, the protrusion 81A of an opening 81 peripheral edge of the holding member 120 abuts against the front wall 101 of the ink tanks 100B, 100Y, 100C, 100M from the front. Therefore, even supposing that a force to move frontward acts on the ink tanks 100B, 100Y, 100C, 100M due to elastic deformation of the seal member 160 when the ink needle 223 enters, the ink needle 223 is prevented from coming out of the through hole of the seal member 160.

Moreover, the ink tanks 100B, 100Y, 100C, 100M, in a state of having engaged with the holding member 120, are slightly movable in the up-down direction 7, the front-rear direction 8, and the left-right direction 9. Therefore, each of the ink tanks 100B, 100Y, 100C, 100M is positioned with reference to a coupling position of the through hole of the sealing member 160 and the ink needle 223. As a result, axial lines of the through hole of the sealing member 160 and the ink needle 223 are prevented from becoming misaligned.

Moreover, by engagement of the ink tanks 100B, 100Y, 100C, 100M and the holding member 120, it is suppressed that the films 142, 143 of the ink tanks 100B, 100Y, 100C, 100M contact each other.

Moreover, by engagement of the ink tanks 100B, 100Y, 100C, 100M and the coupling member 200, specifically, by engagement with the opening 218 of the protrusion 136, it is even more suppressed that the films 142, 143 of the ink tanks 100B, 100Y, 100C, 100M contact each other.

Moreover, in a state of the holding member 120 covering the front of each of the ink tanks 100B, 100Y, 100C, 100M, the first line 146 and the second line 147 are visually confirmable via the opening 81.

Due to the above-described embodiment, the holding member 120 holds the plurality of ink tanks 100, whereby the plurality of ink tanks 100 are integrated. As a result, misalignment between each of the ink tanks 100 can be reduced in a state where the holding member is supported by the casing 14.

Moreover, due to the above-described embodiment, the plurality of ink tanks 100 are held in the holding member 120 in a state that the gap 98 has been left between each of the ink tanks 100 in the left-right direction 9, as depicted in FIG. 13. This makes it possible to prevent contact of films 142, 143 of adjacent ink tanks 100. As a result, a possibility of damage of the films 142, 143 can be lowered.

Moreover, due to the above-described embodiment, the holding member 120 holds the plurality of ink tanks 100 in a state of being aligned in the left-right direction 9. Now, the front surface of the tank main body 141 of each of the ink tanks 100 is accessible from outside of the casing 14 of the multifunction peripheral 10, via the opening 22. In other words, the front surface of the tank main body 141 of each of the ink tanks 100 is exposable to outside of the casing 14 of the multifunction peripheral 10. However, due to the above-described embodiment, the holding member 120 covers the front surface of the tank main body 141 of each of the ink tanks 100.

Since the holding member 120 covers the front surface of each of the ink tanks 100 in this way, the holding member 120 covers also the gap 98 between the front surfaces of the tank main bodies 141 of adjacent ink tanks 100. As a result, even if the films 142, 143 configuring the right surface and the left surface of the tank main body 141 of each of the ink tanks 100 protrude from the gap 98 or can be visually confirmed via the gap 98, the films 142, 143 are covered by the holding member 120. In other words, the films 142, 143 are not exposed to outside of the casing 14. As a result, the possibility of damage of the films 142, 143 can be lowered.

Moreover, due to the above-described embodiment, when the front wall 101 of the ink tank 100 is formed by a material having translucency, ink stored in the ink chamber 111 can be visually confirmed via the opening 81.

Moreover, due to the above-described embodiment, the user can access the inlet 112 via the opening 82 and supply ink to the ink chamber 111 in a state of the holding member 120 holding the plurality of ink tanks 100.

Moreover, due to the above-described embodiment, when at least one of the plurality of caps 113 is in a position misaligned in the left-right direction 9 from the sealing position, this misaligned cap 113 and the rib 93 of the cover 70 make contact. Therefore, the cover 70 cannot be moved to the closed position. In other words, it can be recognized whether the cap 113 is in an inappropriate position or not by whether the cover 70 can be moved to the closed position or not.

Moreover, due to the above-described embodiment, when at least one of the plurality of caps 113 moves from the sealing position to a separated position side, specifically, when at least one of the plurality of caps 113 is not sufficiently inserted into the inlet 112, this cap 113 and the second wall 92 of the cover 70 make contact. Therefore, the cover 70 cannot be moved to the closed position. In other words, it can be recognized whether the cap 113 is in an inappropriate position or not by whether the cover 70 can be moved to the closed position or not.

Moreover, due to the above-described embodiment, the holding member 120 is positioned by the protrusions 108, 109 and the openings 79, 80 engaging. As a result, each of the ink tanks 100 held in the holding member 120 can be prevented from being misaligned in the front-rear direction 8.

Moreover, due to the above-described embodiment, the front section of the right surface (the right wall 159) of the ink tank 100B (an example of a first ink tank) positioned on the right end of the plurality of ink tanks 100 held by the holding member 120 and the front section of the left surface (the left wall 103) of the ink tank 100M (an example of a second ink tank) positioned on the left end of the plurality of ink tanks 100 held by the holding member 120, can be covered by the holding member 120. As a result, even if the film 142 in the rear section of the right surface of the ink tank 100B has been extended out to the front section of the right surface of the ink tank 100B or the film 143 in the rear section of the left surface of the ink tank 100M has been extended out to the front section of the left surface of the ink tank 100M, the holding member 120 covers the extended-out films 142, 143. Therefore, the possibility of damage of the films 142, 143 can be lowered.

Modified Embodiments

In the above-described embodiment, the protrusion 108 and the opening 79 were engaged, and the protrusion 109 and the opening 80 were engaged. However, a shape or arrangement, number, and so on, of these engaging portions are an example, and may be appropriately changed.

Figure 15:
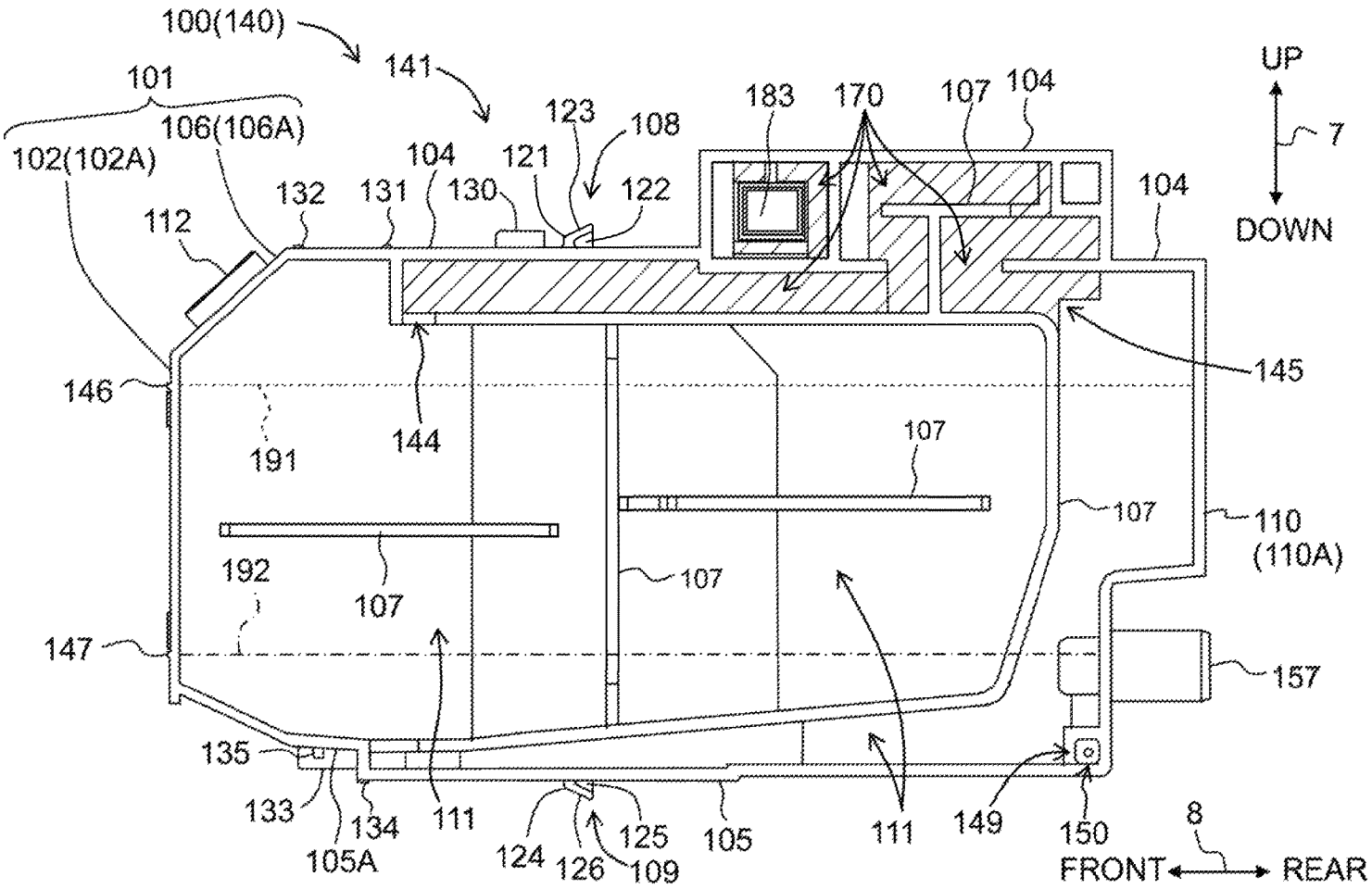
FIG. 15 is a side view of an ink tank in a modified example.
Figure 16A:
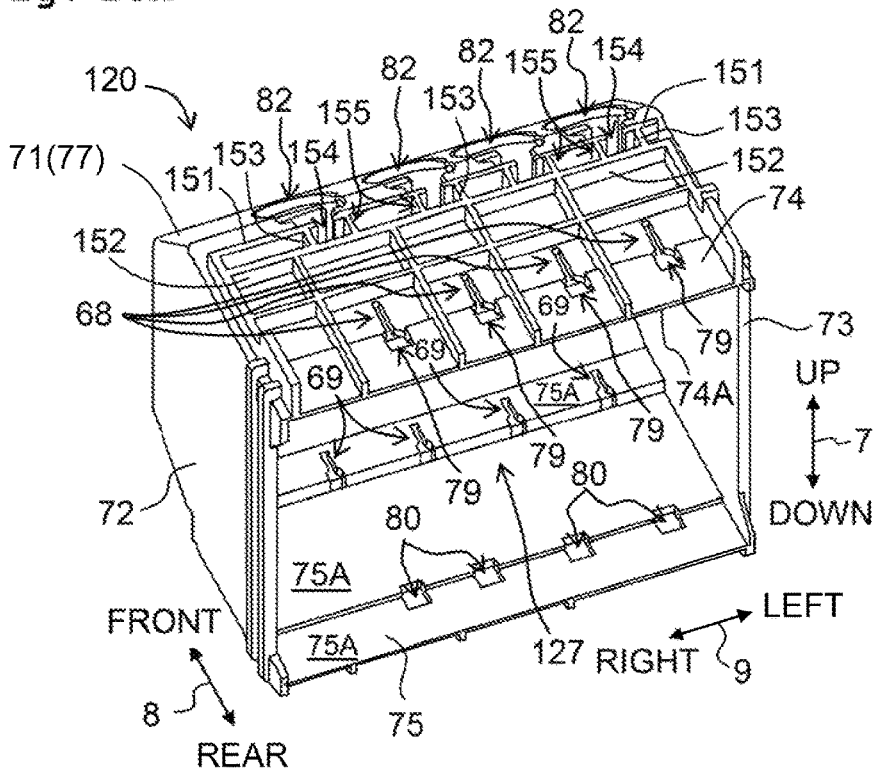
FIG. 16A is a rear perspective view of a holding member in the modified example.

For example, as depicted in FIG. 15, a protrusion 130 may be formed on the upper wall 104 of each of the ink tanks 100. The protrusion 130 is formed more frontward than the protrusion 108, and extends in the front-rear direction 8. Moreover, as depicted in FIG. 16A, a plurality of openings 68 may be formed in the upper wall 74 of the holding member 120. Each of the openings 68 may extend further frontward from each of the openings 70. In other words, four of the opening 68 may be formed. Each of the openings 68 is formed in a position corresponding to the protrusion 130 of each of the ink tanks 100, in a state where each of the ink tanks 100 has been inserted into the internal space 127.

Figure 16B:
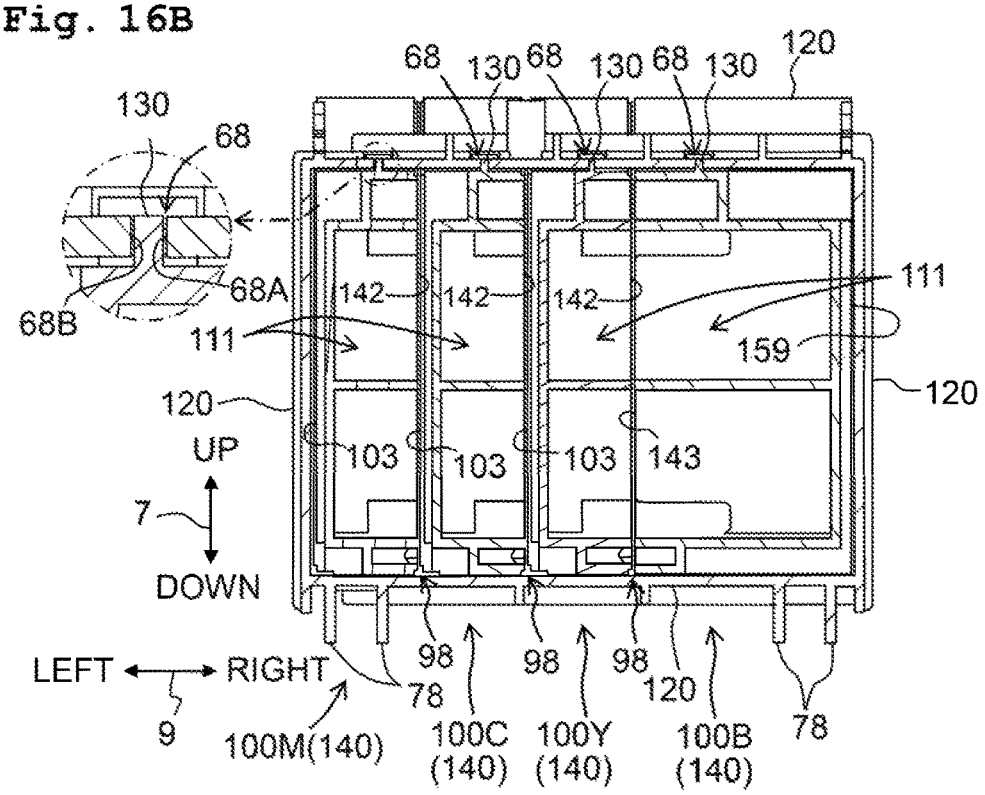
FIG. 16B is a cross-sectional view of the holding member and a tank set in the modified example.

Moreover, as depicted in FIG. 16B, in a state where the protrusion 108 and opening 79 have been engaged and the protrusion 109 and opening 80 have been engaged, the protrusion 130 is inserted into the opening 68. In an inserted state of the protrusion 130 into the opening 68, if the ink tank 100 attempts to move rightwards with respect to the holding member 120, the protrusion 130 abuts against a right edge surface 68A demarcating a right end of the opening 68. Moreover, in an inserted state of the protrusion 130 into the opening 68, if the ink tank 100 attempts to move leftwards with respect to the holding member 120, the protrusion 130 abuts against a left edge surface 68B demarcating a left end of the opening 68. In this case, each of the edge surfaces 68A, 68B of the opening 68 are examples of an abutting section.

In the above-described embodiment, the protrusions 108, 109 of the ink tank 100 were examples of an engaging section, the opening 79 and the opening 80 of the holding member 120 were examples of an engaged section, and each of the edge surfaces 69A, 69B of the opening 69 were examples of an abutting section. However, the engaging section, the engaged section, and the abutting section may be portions different from in the above-described embodiment, on condition that they function to position the ink tank 100.

For example, the abutting section may be a rib protruding downwardly from the upper wall 74 and extending in the front-rear direction 8 and a rib protruding upwardly from the lower wall 75 and extending in the front-rear direction 8. These ribs are positioned between adjacent ink tanks 100 in the left-right direction 9. The ink tank 100 is positioned in the left-right direction 9 by these ribs abutting against the ink tank 100. Moreover, in a positioned state of the ink tank 100, the gap 98 corresponding to a length in the left-right direction 9 of these ribs is formed between adjacent ink tanks 100.

In the above-described embodiment, each of the edge surfaces 69A, 69B of the opening 69 of the holding member 120, in other words, the abutting section, abutted against the protrusion 133 of the ink tank 100. However, what the abutting section abuts against may be a portion other than the protrusion 133 in the ink tank 100. However, what the abutting section abuts against is limited to a portion other than the films 142, 143 in the ink tank 100.

A portion abutting against the ink tank 100 to position the ink tank 100 in the left-right direction 9, in other words, the abutting section, does not abut against the films 142, 143 of the ink tank 100. Therefore, damage of the films 142, 143 due to their abutting against the abutting section, can be prevented.

Moreover, in the above-described embodiment, the holding member 120 and the coupling member 200 are both fixed to the casing 14, but it is possible for only one of the holding member 120 or the coupling member 200 to be fixed to the casing 14. For example, the coupling member 200 may be fixed to the casing 14, and the holding member 120 may be fixed to the coupling member 200.

Moreover, in the above-described embodiment, ink was described as an example of a liquid. However, the present teaching is not limited to this. That is, the likes of a pretreatment liquid discharged onto a recording sheet prior to the ink during printing, or water sprayed in a vicinity of the nozzle 40 of the recording head 39 for preventing drying of the nozzle 40 of the recording head 39, are also an example of a liquid.

What is claimed is:

1. A supply apparatus comprising:

a tank in which a liquid supply section is formed, the liquid supply section having a liquid storage chamber, an inlet for supplying liquid to the liquid storage chamber, and a liquid flow path, the liquid storage chamber being demarcated by a pair of first surfaces facing in a first direction, a second surface joining the pair of first surfaces, and a third surface separated from the second surface in a second direction orthogonal to the first direction, the liquid flow path extending in the second direction from the liquid storage chamber;

a holding member configured to hold a part of the tank from one side in the second direction;

a coupling member having a coupling section, the coupling section being coupled to the liquid supply section of the tank from another side in the second direction to allow the liquid in the liquid storage chamber to flow; and a casing configured to support at least one of the holding member and the coupling member, wherein the second surface and the third surface compose a tank main body, at least a part of each of the pair of first surfaces is formed by a film attached to the tank main body, and the holding member has an abutting section that abuts against the tank main body from the one side in the second direction and a first engaging section that engages with the tank main body such that the tank is movable in the first direction.

2. The supply apparatus according to claim 1, wherein the tank is one of tanks aligned in the first direction, the tanks have liquid supply sections including the liquid supply section, the coupling member has coupling sections including the coupling section, the holding member has first engaging sections including the first engaging section, the coupling sections are respectively coupled to the liquid supply sections of the tanks, and the first engaging sections are configured to engage the tanks in the first direction while leaving a gap between each of the tanks.

3. The supply apparatus according to claim 1, wherein the coupling member has a second engaging section that is configured to engage with the tank main body such that the tank is movable in the first direction.

4. The supply apparatus according to claim 1, wherein the holding member is configured to house a part of the tank main body such that the tank is movable in a third direction orthogonal to each of the first direction and the second direction.

5. The supply apparatus according to claim 1, wherein the casing is configured to support each of the holding member and the coupling member.

6. The supply apparatus according to claim 1, wherein the coupling member has a tube that is inserted into the liquid flow path.

7. The supply apparatus according to claim 1, wherein the holding member has an opening through which a part of the tank main body is exposed in the second direction.

8. The supply apparatus according to claim 7, wherein the part of the tank main body exposed through the opening of the holding member is provided with:

a first mark provided at a position corresponding to a liquid surface in a state that a first amount of the liquid is stored in the liquid storage chamber; and a second mark provided at a position corresponding to a liquid surface in a state that a second amount of the liquid is stored in the liquid storage chamber, the second amount being less than the first amount.

9. A supply apparatus comprising:

tanks each having a liquid storage chamber demarcated by a pair of first surfaces facing in a first direction and an inlet for supplying a liquid to the liquid storage chamber;

a holding member configured to hold the tanks in a state of being aligned in the first direction; and a casing configured to support the holding member, wherein at least a part of each of the pair of first surfaces is formed by a film, the holding member has abutting sections that respectively abut against the tanks to position the tanks in the first direction while leaving a gap between each of the tanks, the casing comprises a side wall having a first opening, each of the tanks is disposed in the casing such that a second surface joining the pair of first surfaces is accessible from outside of the casing via the first opening, and the holding member covers the second surface of each of the tanks.

10. The supply apparatus according to claim 9, wherein the holding member comprises a second opening through which a part of the second surface of each of the tanks is exposed.

11. The supply apparatus according to claim 10, wherein the second surface is provided with:

a first mark provided at a position corresponding to a liquid surface in a state that a first amount of the liquid is stored in the liquid storage chamber; and a second mark provided at a position corresponding to a liquid surface in a state that a second amount of the liquid is stored in the liquid storage chamber, the second amount being less than the first amount.

12. A supply apparatus comprising:

tanks each having a liquid storage chamber demarcated by a pair of first surfaces facing in a first direction and an inlet for supplying a liquid to the liquid storage chamber;

a holding member configured to hold the tanks in a state of being aligned in the first direction; and a casing configured to support the holding member, wherein at least a part of each of the pair of first surfaces is formed by a film, the holding member has abutting sections that respectively abut against the tanks to position the tanks in the first direction while leaving a gap between each of the tanks, and the holding member comprises a third opening through which the inlet of each of the tanks is exposed.

13. A supply apparatus comprising:

tanks each having a liquid storage chamber demarcated by a pair of first surfaces facing in a first direction and an inlet for supplying a liquid to the liquid storage chamber;

a holding member configured to hold the tanks in a state of being aligned in the first direction; and a casing configured to support the holding member, wherein at least a part of each of the pair of first surfaces is formed by a film, the holding member has abutting sections that respectively abut against the tanks to position the tanks in the first direction while leaving a gap between each of the tanks, each of the caps is provided corresponding to the inlet, and is movable to a sealing position sealing the inlet and a separated position separated from the inlet, the holding member comprises cap attachment portions to which the caps are respectively attached, the casing comprises a side wall having a first opening, each of the tanks is disposed in the casing so as to be accessible from outside of the casing via the first opening, the supply apparatus further comprises a cover movable to a closed position covering the first opening and an open position exposing the first opening, and the cover comprises ribs that are positioned between the caps in the sealing position in a state of the cover being in the closed position.

14. A supply apparatus comprising:

tanks each having a liquid storage chamber demarcated by a pair of first surfaces facing in a first direction and an inlet for supplying a liquid to the liquid storage chamber;

a holding member configured to hold the tanks in a state of being aligned in the first direction; and a casing configured to support the holding member, wherein at least a part of each of the pair of first surfaces is formed by a film, the holding member has abutting sections that respectively abut against the tanks to position the tanks in the first direction while leaving a gap between each of the tanks, each of the caps is provided corresponding to the inlet, and is movable to a sealing position sealing the inlet and a separated position separated from the inlet, the holding member comprises cap attachment portions to which the caps are respectively attached, the casing comprises a side wall having a first opening, each of the tanks is disposed in the casing so as to be accessible from outside of the casing via the first opening, the supply apparatus further comprises a cover movable to a closed position covering the first opening and an open position exposing the first opening, and the cover comprises a restricting portion that is provided at a position abutting against the caps in the sealing position or at a position in a vicinity of the caps in the sealing position, and restricts movement of each of the caps from the sealing position.

15. A supply apparatus comprising:

tanks each having a liquid storage chamber demarcated by a pair of first surfaces facing in a first direction and an inlet for supplying a liquid to the liquid storage chamber;

a holding member configured to hold the tanks in a state of being aligned in the first direction; and a casing configured to support the holding member, wherein at least a part of each of the pair of first surfaces is formed by a film, the holding member has abutting sections that respectively abut against the tanks to position the tanks in the first direction while leaving a gap between each of the tanks, the tanks comprise engaging portions that engage with the holding member, the holding member comprises engaged portions that respectively engage with the engaging portions, and by engagement of the engaging portions and the engaged portions, the tanks are positioned with respect to a second direction orthogonal to the first direction.

16. A supply apparatus comprising:

tanks each having a liquid storage chamber demarcated by a pair of first surfaces facing in a first direction and an inlet for supplying a liquid to the liquid storage chamber;

a holding member configured to hold the tanks in a state of being aligned in the first direction; and a casing configured to support the holding member, wherein at least a part of each of the pair of first surfaces is formed by a film, the holding member has abutting sections that respectively abut against the tanks to position the tanks in the first direction while leaving a gap between each of the tanks, the tanks held in the holding member include a first tank and a second tank which are arranged at outermost positions in the first direction, the first tank has an outer first surface which is one of the pair of first surfaces and which is further from the second tank in the first direction, the second tank has an outer first surface which is one of the pair of first surfaces and which is further from the first tank in the first direction, and the holding member covers at least a part of the outer first surface of the first tank and at least a part of the outer first surface of the second tank.

17. A supply apparatus comprising:

tanks each having a liquid storage chamber demarcated by a pair of first surfaces facing in a first direction and an inlet for supplying a liquid to the liquid storage chamber;

a holding member configured to hold the tanks in a state of being aligned in the first direction; and a casing configured to support the holding member, wherein at least a part of each of the pair of first surfaces is formed by a film, the holding member has abutting sections that respectively abut against the tanks to position the tanks in the first direction while leaving a gap between each of the tanks, and each of the abutting sections abuts against a portion other than the film of each of the tanks.

18. A supply apparatus comprising:

tanks each having a liquid storage chamber demarcated by a pair of first surfaces facing in a first direction and an inlet for supplying a liquid to the liquid storage chamber;

a holding member configured to hold the tanks in a state of being aligned in the first direction; and a casing configured to support the holding member, wherein at least a part of each of the pair of first surfaces is formed by a film, the holding member has abutting sections that respectively abut against the tanks to position the tanks in the first direction while leaving a gap between each of the tanks, the first direction is parallel to a horizontal direction, and a dimension in the first direction of each of the tanks is shorter than a dimension in a second direction orthogonal to the first direction and parallel to the horizontal direction, and is shorter than a dimension in a vertical direction.

* * * * *